US011199373B1

(12) United States Patent
Watkins

(10) Patent No.: US 11,199,373 B1
(45) Date of Patent: Dec. 14, 2021

(54) FIRE CONTROL / TRIGGER MECHANISM

(71) Applicant: Next Level Designs, LLC, Elizabethtown, KY (US)

(72) Inventor: Derek Watkins, Elizabethtown, KY (US)

(73) Assignee: NEXT LEVEL DESIGNS, LLC, Elizabethtown, KY (US)

( * ) Notice: Subject to any disclaimer, the term of this patent is extended or adjusted under 35 U.S.C. 154(b) by 0 days.

(21) Appl. No.: 17/217,627

(22) Filed: Mar. 30, 2021

Related U.S. Application Data

(60) Provisional application No. 63/001,985, filed on Mar. 30, 2020.

(51) Int. Cl.
*F41A 19/12* (2006.01)
*F41A 19/34* (2006.01)
*F41A 19/32* (2006.01)

(52) U.S. Cl.
CPC ..... *F41A 19/12* (2013.01); *F41A 19/32* (2013.01); *F41A 19/34* (2013.01)

(58) Field of Classification Search
CPC ..... F41A 19/12; F41A 19/32
USPC ..... 42/69.01, 69.02
See application file for complete search history.

(56) References Cited

U.S. PATENT DOCUMENTS 935,237 A 9/1909 Savage
2,605,756 A 8/1952 Bertschinger
2,855,716 A 10/1958 Campbell
3,075,312 A 1/1963 Walker
3,255,545 A 6/1966 Chambers et al.
4,411,087 A 10/1983 Aikman
4,445,292 A 5/1984 Martin
4,475,438 A 10/1984 Sullivan
4,866,869 A 9/1989 Mainland
4,908,970 A 3/1990 Bell
5,115,588 A 5/1992 Bronsart et al.
(Continued)

FOREIGN PATENT DOCUMENTS

CN 209802186 U 12/2019
EP 1634032 B1 1/2007

OTHER PUBLICATIONS

SIG SAUER; SIG716 Owners Manual: Handling & Safety Instructions; www.sigsauer.com; P/N 1800058 REV 01; available prior to Mar. 30, 2020.

(Continued)

*Primary Examiner* — Reginald S Tillman, Jr.
(74) *Attorney, Agent, or Firm* — Womble Bond Dickinson (US) LLP

(57) ABSTRACT

A trigger mechanism or fire control for trigger operable devices includes a housing; a sear having a sear body coupled to the housing and including a primary engagement surface and an active sear support reset geometry; and a sear support coupled to the housing and having a body with a sear engagement surface and a passive sear support reset geometry. The primary engagement surface of the sear is moved into an overlapping condition with the sear engagement surface of the sear support as the sear is moved from a discharged position to a reset position after actuation of the trigger operable device. In addition, interaction between the active sear support reset geometry and the passive sear support reset geometry causes a mechanical displacement of the sear support to a reset position.

13 Claims, 12 Drawing Sheets

(56) References Cited

U.S. PATENT DOCUMENTS

| | | | | |
|---|---|---|---|---|
| 5,245,776 | A | 9/1993 | Dornaus | |
| 5,349,939 | A | 9/1994 | Perrone | |
| 5,373,775 | A | 12/1994 | Findlay, Sr. et al. | |
| 5,595,165 | A | 1/1997 | Conte | |
| 5,640,794 | A * | 6/1997 | Gardner | F41A 19/35 42/69.02 |
| 5,697,178 | A | 12/1997 | Haskell | |
| 5,726,377 | A | 3/1998 | Harris et al. | |
| 5,852,891 | A | 12/1998 | Onishi et al. | |
| 5,857,280 | A | 1/1999 | Jewell | |
| 6,382,200 | B1 * | 5/2002 | Levkov | F41A 19/12 124/71 |
| 6,615,527 | B1 | 9/2003 | Martin | |
| 7,047,685 | B2 | 5/2006 | Diaz et al. | |
| 7,051,467 | B1 | 5/2006 | Huber | |
| 7,086,191 | B2 | 8/2006 | Orr | |
| 7,181,880 | B2 | 2/2007 | Keeney | |
| 7,430,827 | B1 | 10/2008 | Huber | |
| 7,600,338 | B2 | 10/2009 | Geissele | |
| 7,743,543 | B2 | 6/2010 | Karagias | |
| 7,930,848 | B2 | 4/2011 | Dye, Jr. | |
| 8,234,969 | B2 | 8/2012 | Beckmann | |
| 8,522,466 | B2 | 9/2013 | Arduini | |
| 9,046,313 | B1 | 6/2015 | Lutton et al. | |
| 9,097,485 | B2 | 8/2015 | Lipowski | |
| 9,267,750 | B1 | 2/2016 | Tubb | |
| 9,541,341 | B2 * | 1/2017 | Macy | F41A 19/16 |
| 9,638,485 | B2 | 5/2017 | Geissele | |
| 9,689,938 | B2 | 6/2017 | Imamura et al. | |
| 9,989,327 | B2 | 6/2018 | Horch | |
| 10,001,335 | B2 | 6/2018 | Patterson et al. | |
| 10,006,732 | B2 | 6/2018 | Reynolds | |
| 10,156,410 | B1 | 12/2018 | McKillips et al. | |
| 10,295,289 | B2 | 5/2019 | Geissele | |
| 10,401,108 | B2 | 9/2019 | Schafer et al. | |
| 10,809,031 | B2 | 10/2020 | Geissele et al. | |
| 2009/0188145 | A1 | 7/2009 | Fluhr et al. | |
| 2016/0377363 | A1 | 12/2016 | Lipowski | |
| 2017/0115089 | A1 | 4/2017 | Middleton | |
| 2017/0205171 | A1 | 7/2017 | Burmood | |

OTHER PUBLICATIONS

Sigarms Inc.: Sigarms SIG 556 Semi-Automatic Rifle 5.56 mm NATO (.223 Remington) Instruction Manual; P/N 1511203 VER 12.07.2; available prior to Mar. 30, 2020.

* cited by examiner

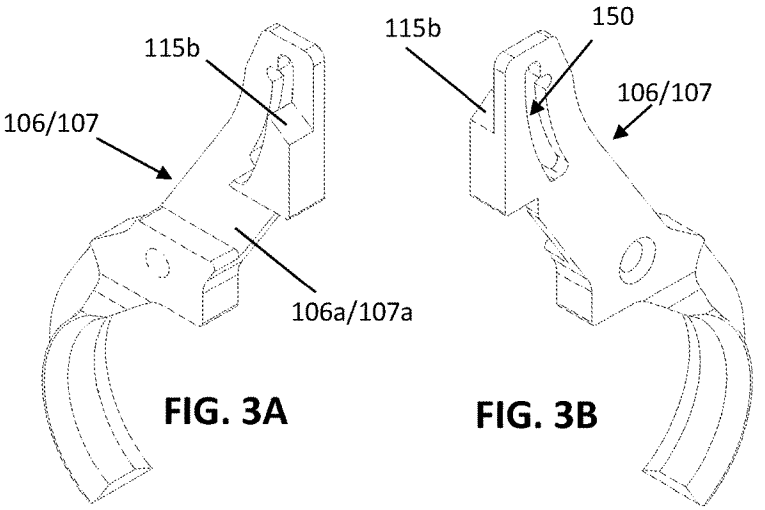
FIG. 3A
FIG. 3B
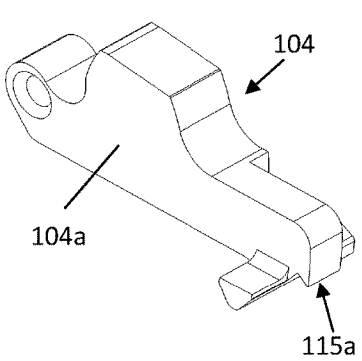
FIG. 3C
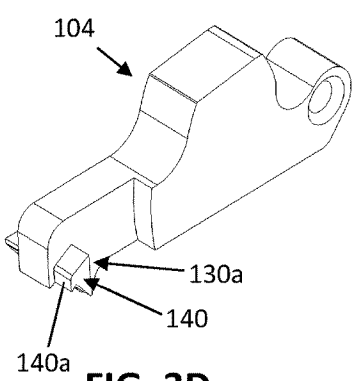
FIG. 3D
FIG. 3E
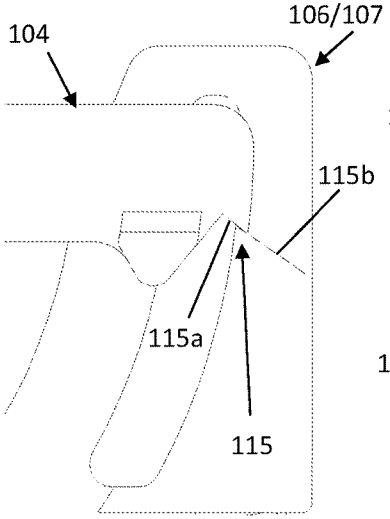
FIG. 3F
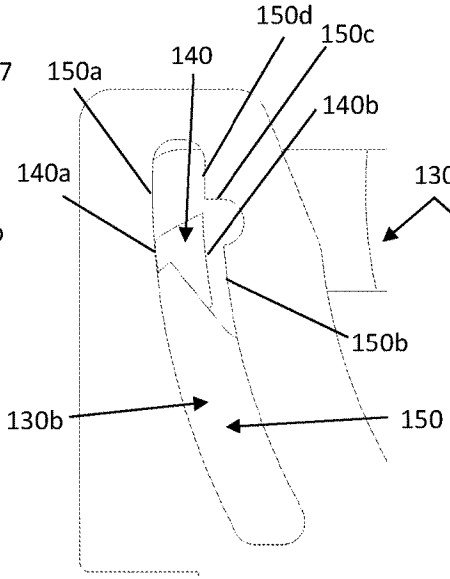
FIG. 3G
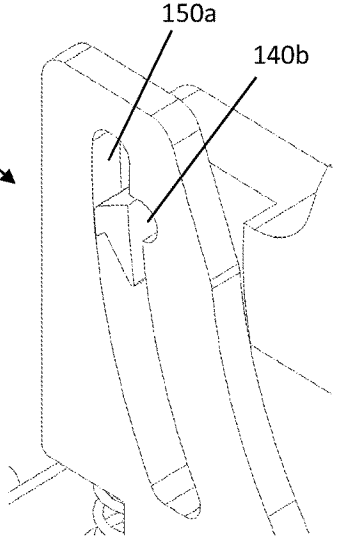
FIG. 3H

FIRE CONTROL / TRIGGER MECHANISM

CROSS-REFERENCE TO RELATED APPLICATIONS

The present Patent application claims the benefit of U.S. Provisional Patent Application No. 63/001,985, filed on Mar. 30, 2020.

INCORPORATION BY REFERENCE

The disclosures made in U.S. Provisional Patent Application No. 63/001,985, filed on Mar. 30, 2020, are specifically incorporated by reference herein as if set for in their entirety.

TECHNICAL FIELD

Embodiments described herein generally relate to trigger mechanisms and/or fire controls and, more specifically, to embodiments for improving operation of trigger operated devices.

BACKGROUND

In general, trigger mechanisms are a form of switch that is toggled from a predischarge and discharged condition via an external excitation force(s) exerted on a body of the switch by the user/operator. When the switch moves from the loaded/cocked position to the unloaded/decocked position the switch is considered to have been triggered. Trigger mechanisms come in many shapes, sizes and types. Trigger mechanisms that are typically employed when a large force or load needs to be restrained and then released by the application of a relatively small force (compared to the restrained force) are often of a sear override type. Trigger mechanisms of the sear override variety are commonly found in industrial equipment such as pneumatic presses; construction equipment such as nailers; general equipment such as door latches; hunting equipment such as firearms; and military equipment such small arms and light weapons, to name a few.

A firearm's trigger mechanism generally contains a trigger and associated components for discharging the firearm upon application of a trigger pull force to the trigger, and is generally called a fire control. During use, such as training and combat, military firearms are subjected to different environments and conditions, often the harshest environments in the world and are subjected to extreme environmental and physical abuse. Typically, the lighter/lower a trigger pull force is set to, the more susceptible the fire control becomes to being jammed if mud, dirt, ice, sand, etc. enter and/or become lodged inside the fire control. If the fire control operation is hampered or blocked, a soldier's firearm can be rendered inactive, and the safety and effectiveness of the soldier and soldier's team may be significantly compromised. Historically, light/low trigger pull force settings also tend to reduce the fire control's robustness to impacts, such as being dropped, which can lead to an accidental discharge of a firearm in or outside of combat, which further can compromise the safety of the soldier and the soldier's team. Some current solutions for improving a fire control's robustness to adverse environmental conditions and physical abuse include increasing the trigger pull force required to displace the trigger and/or increasing the distance the trigger must travel or be displaced before the firearm can be made to discharge. However, increasing a trigger's displacement pull force and/or increasing a travel distance for a trigger also can add challenges to an operator's ability to be accurate and effective under pressure, which in turn can compromise the soldier and his or her team.

Accordingly, a need exists in the industry for a fire control or trigger mechanism that addresses the foregoing and other related and unrelated challenges in the art.

SUMMARY

Briefly described, embodiments of various aspects of the trigger mechanisms or fire controls disclosed herein are presented. In particular, the present disclosure relates to fire control or trigger mechanisms including embodiments of a sear override fire control. Furthermore, by addressing the challenges presented by military use in extreme environments and physical abuse conditions, the performance and robustness of trigger mechanisms (not just fire controls) utilized in civilian and industrial applications can be enhanced.

Aspects of the present disclosure can include, without limitation, A trigger mechanism, comprising a housing; a sear having a sear body coupled to the housing, the sear body comprising a primary engagement surface, and an active sear support reset geometry; and a sear support coupled to the housing, the sear support having a body with a first end, a second end, a sear engagement surface, and a passive sear support reset geometry, wherein the primary engagement surface of the sear cooperatively translates to an overlapping condition with the sear engagement surface of the sear support as the sear is moved from a discharged position to a reset position. The motion of the sear from a discharged position to a reset position causes mechanical displacement of the sear support to a reset position via the active sear support geometry of the sear cooperatively engaging the passive sear support geometry of the sear support. The reset motion of the sear actively resets the sear support.

In embodiments of the trigger mechanism a passive sear reset spring is configured to provide a selected sear reset force directed against the body of the sear so as to urge the sear towards its reset position.

In the embodiments of trigger mechanisms presented here, the discharged condition of the trigger mechanism is defined as when the primary engagement surface of the sear is not in an overlapping condition with the sear engagement surface of the sear support. The reset condition of the trigger mechanism is defined as when the sear's primary engagement surface is in an elevated position above the sear engagement surface of the sear support, but the primary engagement surface is not making contact with the sear engagement surface or an intermediate part (such as a roller) that would make contact with both the primary engagement surface and the sear engagement surface. The cocked condition of a trigger mechanism is defined as when the sear is loaded by the cocking piece and the primary engagement surface is making contact/engaging with the sear engagement surface or an intermediate part (such as a roller) between and making contact with both the primary engagement surface and the sear engagement surface.

In embodiments of the trigger mechanism, the passive sear support reset geometry comprises at least one cam follower surface arranged along the body of the sear support between the first and second ends thereof, and wherein the active sear support reset geometry comprises at least one cam surface arranged along the body of the sear and configured to engage the at least one cam follower surface of the sear support body as the sear is moved from its discharged position to its reset position so as to mechanically displace the sear support body toward its reset position.

In other embodiments of the trigger mechanism, the body of the passive sear support reset further comprises at least one channel defined along the body of the sear support, and the passive sear support reset geometry comprise at least one cam follower surface arranged along the channel; and wherein the active sear support reset geometry comprises at least one sear support reset cam projecting from the sear body and cooperatively engaging at least one cam follower surface of the sear support body such that as the sear is displaced from its discharged position to its reset position, movement of the cam of the sear along at least one cam follower surface of the sear support mechanically displaces the sear support to its reset position.

In some embodiments of the trigger mechanism, the passive sear support reset geometry comprises at least one cam defined along the body of the sear support, and wherein the active sear support reset geometry comprises at least one channel along the body of the sear and continued to cooperatively engage the cam of the sear support such that as the sear is displaced from its discharged position to its reset position, movement of the cam of the sear support along at least one surface of the sear mechanically displaces the sear support to its reset position.

In other embodiments, the sear support comprises a trigger body having a first portion defining a trigger bow, a second portion at which the sear engagement surface is located and a third portion having a passive trigger reset cam follower that moves the trigger to its reset position when engaged with the active sear support reset geometry of the sear when the sear is displaced from its discharged position to its reset position.

In other embodiments, the sear support comprises a connector located between the sear and a trigger, the connector having a first portion configured to be contacted by a trigger and rotate the connector when the trigger is pulled, and a second portion configured at which the sear engagement surface is located, and a third portion configured with a passive connector reset cam that moves the connector to its reset position when engaged with the active sear support reset geometry of the sear when the sear is displaced from its discharged position to its reset position. In addition, in some embodiments, the trigger comprises a body configured with an engagement surface that cooperatively mates with a surface of the connector and blocks the connector from rotating when the trigger has not been at least partially moved from an initial, undischarged position, holding the sear engagement surface of the connector in an overlapping condition with the sear's primary engagement surface.

In some embodiments of the trigger mechanism, the sear support comprises a trigger, and the trigger mechanism further comprises a passive sear and trigger reset system including at least one compression spring configured to exert a selected sear reset force against the sear body and a trigger reset force against a trigger pull cam located between the trigger and the at least one compression spring and adapted to communicate the trigger reset force to the trigger via a mechanical advantage of the sear reset spring contacting the trigger reset cam as said cam presses against a portion of the trigger body or trigger body assembly.

Still further, the trigger mechanism can further comprise a trigger reset adjustment member located along the body of the trigger in a position to be engaged by the trigger pull cam; wherein the trigger reset adjustment member is moveable with respect to the trigger so as to adjust a position of contact between the trigger reset adjustment member and the trigger pull cam and selectively adjust the mechanical advantage to thereby adjust an amount of the trigger reset force applied against the trigger assembly.

In embodiments, the trigger mechanism can further comprise a safety arm pivotally attached to the housing, the safety arm having at least one cam surface configured to interact with at least one safety cam follower located along the body of the sear such that when the safety arm is placed in an "On/Safe" position, the sear is displaced to its reset position, cooperatively displacing the sear support to its reset position via interactions between the active and passive sear support reset geometries of the sear and sear support. In some embodiments, the safety arm further comprises a cam surface configured to interact with at least one safety cam follower of the body of the sear and place the sear in its reset position as the safety arm traverses a null position when being moved from its "On/Safe" position to an "Off/Fire" position.

In other aspects of the disclosure, a firearm comprises a striker assembly; a cocking piece moveable between a first position and a second position so as to engage the striker assembly for discharging the firearm; and a trigger mechanism, comprising a sear having a sear body comprising a primary engagement surface, a secondary engagement surface, and a sear reset geometry including at least one reset cam defined along the body, the sear being moveable between a discharge position and a reset position; and a sear support including a sear support body having primary sear engagement surface configured to engage primary engagement surface of the sear body and at least one cam follower arranged along the body of the sear support; wherein the at least one reset cam of the sear cooperatively engages the at least one cam follower of the sear support as the sear is moved from its discharged position to its reset position so as to mechanically displace the sear support body toward a reset position of the sear support; and wherein the cocking piece is configured with at least one sear reset cam that cooperatively engages the secondary engagement surface of the sear, urging the sear to be displaced from its discharged position to its reset position whereby the primary engagement surface of the sear is placed into overlapping engagement with the primary sear engagement surface of the sear support, as the cocking piece translates in a direction toward its first position.

The foregoing and other advantages and aspects of the embodiments of the present disclosure will become apparent and more readily appreciated from the following detailed description and the claims, taken in conjunction with the accompanying drawings. Moreover, it is to be understood that both the foregoing summary of the disclosure and the following detailed description are exemplary and intended to provide further explanation without limiting the scope of the present disclosure.

BRIEF DESCRIPTION OF THE DRAWINGS

The accompanying drawings, which are included to provide a further understanding of the embodiments of the present disclosure, are incorporated in and constitute a part of this specification, illustrate embodiments of this disclosure, and together with the detailed description, serve to explain the principles of the embodiments discussed herein. No attempt is made to show structural details of this disclosure in more detail than may be necessary for a fundamental understanding of the exemplary embodiments discussed herein and the various ways in which they may be practiced. Those skilled in the art further will appreciate and understand that, according to common practice, the various features of the drawings discussed below are not necessarily drawn to scale, and that the dimensions of various features and elements of the drawings may be expanded or reduced to more clearly illustrate the embodiments of the present disclosure described herein; and further that the embodiments set forth in the drawings are illustrative and exemplary in nature and not intended to limit the present disclosure.

FIGS. 3A-3D depict components of the fire control/trigger mechanism of FIGS. 2A and 2B configured with a mating sear support reset features, according to the embodiments of the present disclosure.

FIGS. 3E and 3F depict primary engagement surfaces of the sear and sear support when the fire control/trigger mechanism of FIGS. 2A and 2B is cocked, according to the embodiments of the present disclosure.

FIGS. 3G and 3H depict the active and passive sear support reset geometries of the sear and sear support when the fire control/trigger mechanism of FIGS. 2A and 2B is cocked, according to the embodiments of the present disclosure.

DETAILED DESCRIPTION

Figure 1:
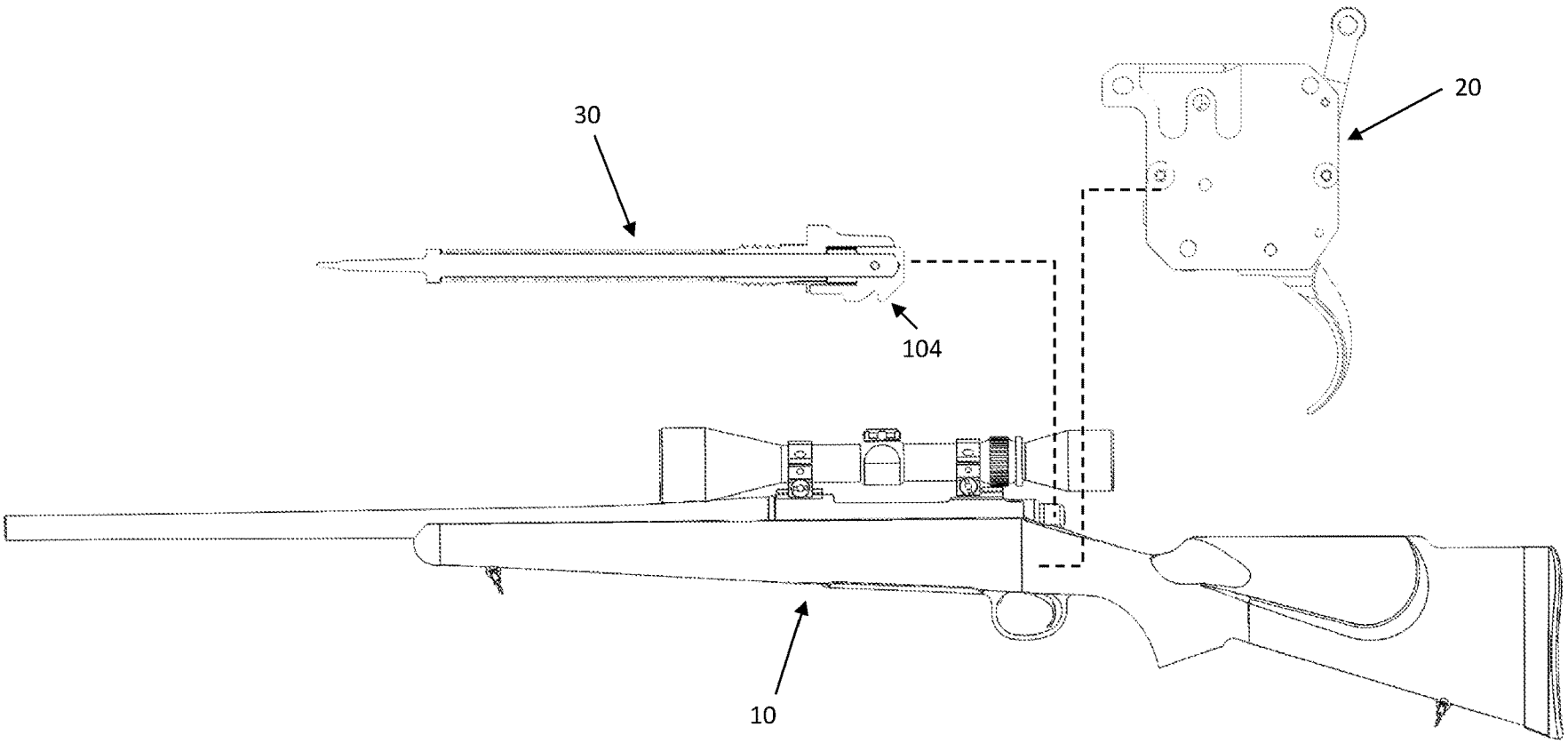
FIG. 1 depicts an example of a sear override fire control/trigger mechanism and its typical location in a bolt action rifle, according to embodiments of the present disclosure.

The following detailed description of the illustrative embodiments can be understood when read in conjunction with the following drawings, wherein like structure(s) is(are) indicated with like reference numerals and in which embodiments of fire controls and/or trigger mechanisms for firearms and other trigger operated devices are disclosed. For example, embodiments of the fire controls/trigger mechanisms disclosed which are applicable to firearms, including various single shot, semi-automatic and fully-automatic firearms, such as, but not limited to, pistols and revolvers, and rifles, shotguns, and other long guns. It will, however, be understood that the fire controls/trigger mechanisms further can be used for operation of other trigger operated or controlled devices such as crossbows, air guns, industrial equipment such as pneumatic presses, construction equipment such as nailers, general equipment such as door latches and other trigger operated equipment.

For purposes of discussion and illustration of the present disclosure, in some aspects, the fire controls/trigger mechanisms discussed herein can be configured for use with a sear system with forced primary engagement between the sear and sear support, and, in embodiments, relate to sear override fire controls/trigger mechanisms 20 for trigger operable devices and subcategories including single-stage and/or two-stage fire controls. Other embodiments relate to two-stage fire control with a connector block. Still further embodiments can include a sear with a cocking piece actuated mechanical reset, and/or a sear with a cocking piece roller. Other embodiments as described herein can include a safety arm with a sear blocking full fire control reset, and some embodiments can include a trigger pull force adjustment cam system. In addition, as noted, while embodiments of the fire controls/trigger mechanisms according to the principles of the present disclosure are shown and described in more detail below with reference to, for example, a bolt action rifle (firearm 10) with a firing pin/striker assembly 30 for firing rounds of ammunition, such as shown in FIG. 1, it will be understood that such references are not to be taken as limiting the present disclosure solely for use with firearms.

Figure 2B:
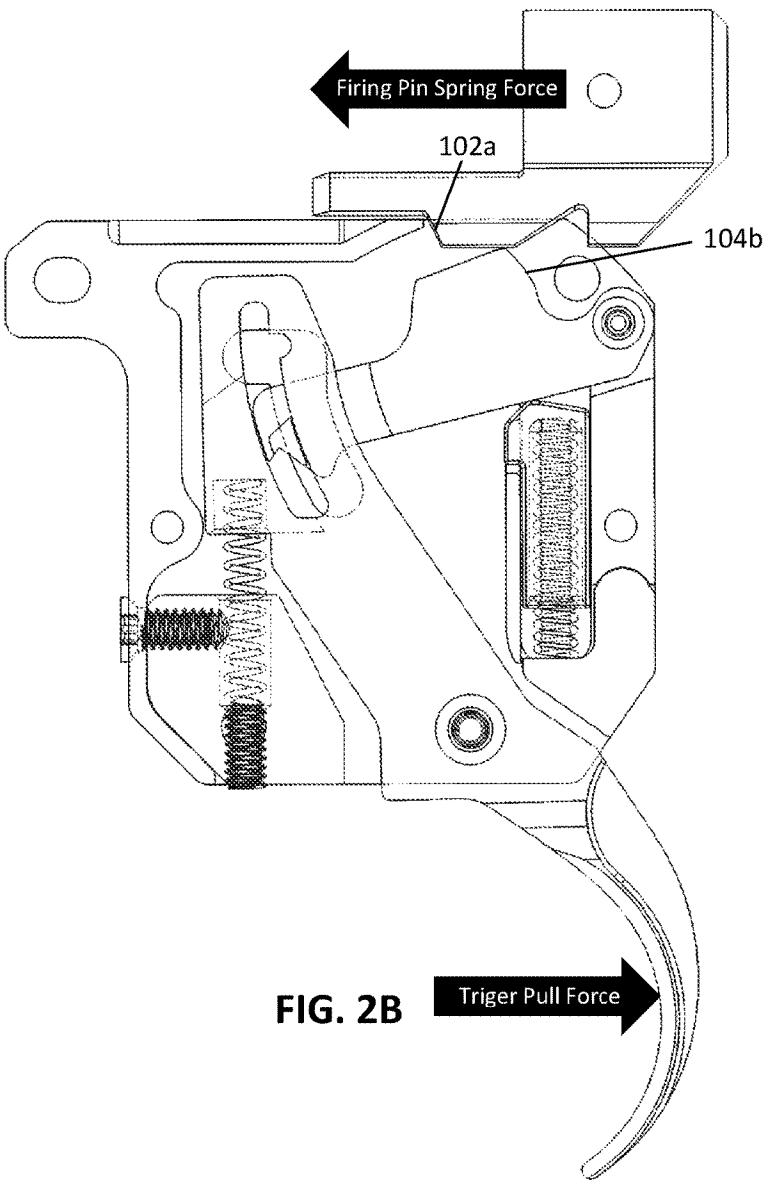
FIGS. 2A and 2B depict a single-stage, sear override fire control/trigger mechanism, according to embodiments of the present disclosure.
Figure 2A:
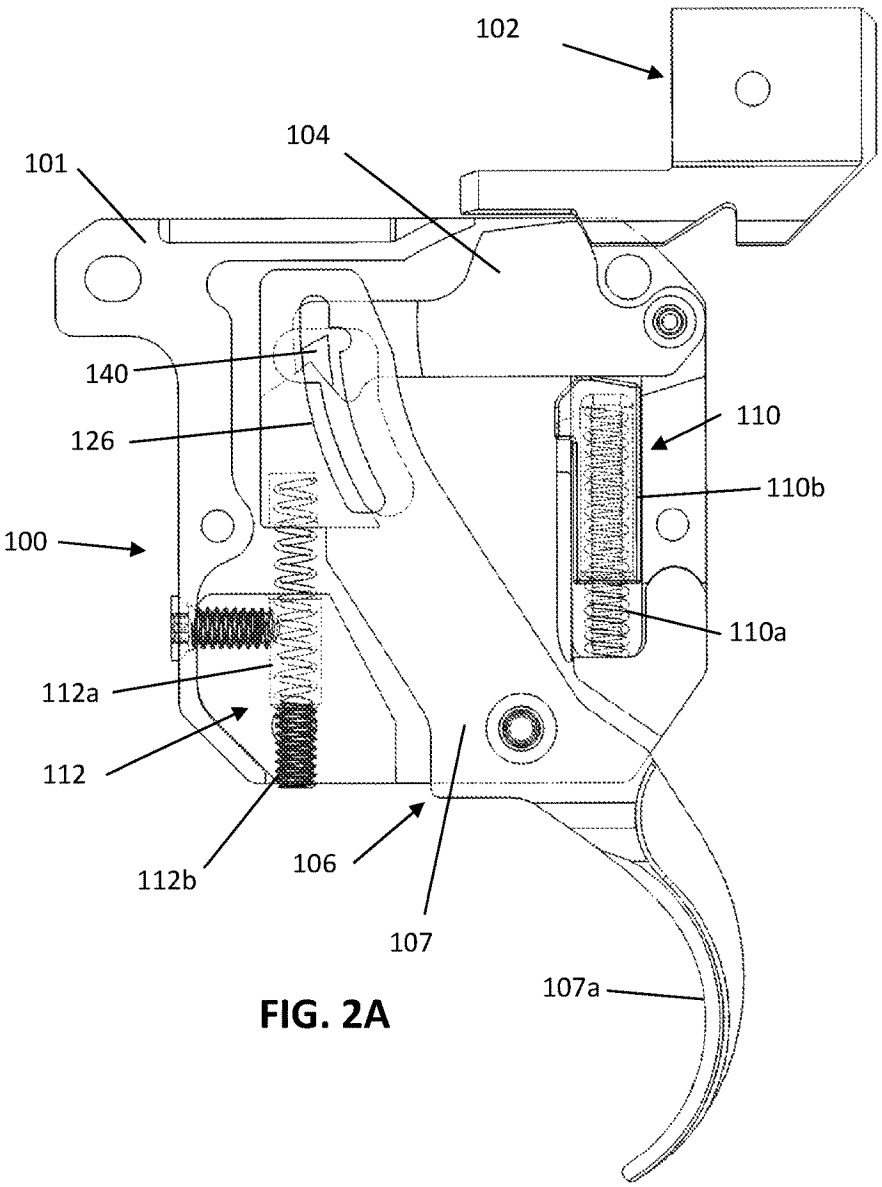

Referring now to the drawings, FIGS. 2A and 2B depict components of a sear override trigger mechanism 20 in a single-stage fire control 100 configuration, according to embodiments of the present disclosure. At its most fundamental level, the foundation of a sear override trigger mechanism/fire control is the sear 104. The sear 104 has two engagement surfaces, its primary engagement surface 115*a* and its secondary engagement surface 104*a*. The primary engagement surface 115*a* is engaged and supported by the sear support 106. The secondary engagement surface 104*a* is engaged and loaded by the cocking piece 102. As long as the sear 104 is supported by the sear support 106, the cocking piece 102 cannot override the sear and discharge the firearm 10. But, when the sear support 106 is displaced (the trigger is fully pulled/displaced) and the sear 104 is not supported, the cocking piece will override the sear and translate the firing pin assembly forward, discharging the firearm.

When an operator initiates the discharge of a sear override fire control, the operator displaces the trigger when the fire control is in the cocked condition. Typically, this is achieved by applying a force against the trigger bow 107*a* in a direction towards the back of the trigger bow 107*a* such that the applied force vector is parallel with the axis of the barrel of firearm 10. The force required to fully pull/displace the trigger is commonly called the trigger pull force and it causes the sear to become unsupported by displacing the sear support/trigger, which in turn releases the cocking piece, enabling it to travel from a first, or cocked position toward a second, discharged position engaging the striker assembly 30 (FIG. 1), after which the cocking piece can be returned to its first or fully retracted position by operation of the firearm (e.g. gas operation, springs, etc.).

As illustrated in FIGS. 2A-2B, the single-stage fire control 100 for a firearm may include a housing or support plate 101, a sear 104, and a sear support 106 (embodied as trigger 107). As discussed further below in embodiments, the sear support 106 can comprise a trigger 107, a connector 207, a linkage, or other mechanism that supports the sear 104 in a cocked position when the sear 104 is engaged by an external force or load initiated by an external actuator such as the cocking piece 102. The fire control 100 further comprises a trigger pull/reset spring system 112, which may include a trigger pull/reset spring 112*a* and a trigger pull/reset spring adjustment screw 112*b*, and a sear reset spring system 110, which may include a sear reset spring 110*a* and a sear reset spring guide 110*b*.

In the embodiments of trigger mechanism 20, the discharged condition of the trigger mechanism 20 is defined as when the primary engagement surface 115*a* of the sear 104 is not in an overlapping condition with the sear engagement surface 115*b* of the sear support 106. The reset condition of the trigger mechanism 20 is defined as when the sear 104's primary engagement surface 115*a* is in an elevated position above and overlapping the sear engagement surface 115*b* of the sear support 106, but the primary engagement surface 115*a* is not making contact with the sear engagement surface 115*b* or an intermediate part (such as a roller) that would bridge the contact between the primary engagement surface 115*a* and the sear engagement surface 115*b*. The cocked condition of a trigger mechanism is defined as when the sear 104 is loaded by the cocking piece 102 and the primary engagement surface 115*a* is making contact/engaging with the sear engagement surface 115*b* or making contact/engaging an intermediate part (such as a roller) bridging contact between the primary engagement surface 115*a* and the sear engagement surface 115*b*.

The single stage fire control 100 interacts with the cocking piece 102 (a part typically external to the fire control 100) and controls the positioning of the cocking piece 102 via its interaction with the sear 104. When the fire control 100 is in the cocked condition (FIG. 2A), the firing pin/striker assembly 30 is held in a cocked position via its primary sear engagement surface 102*a* of the cocking piece 102 (typically a component integral to the firing pin/striker assembly 30) engaging the secondary engagement surface 104*b* of the sear 104. As indicated in FIGS. 2A and 2B, the cocking piece 102 (part of the firing pin assembly) translates or moves between a first, rearward or retracted position, a second, cocked position when its sear loading surface 102*a* is engaged with the sear 104's secondary engagement surface 104*b* (FIG. 2A) and a third, forward (decocked) or firing/discharged position out of engagement with the sear (FIG. 2B). When fire control 100 is cocked, the sear 104 is held in place in its cocked position by the sear 104's primary engagement 115 with the sear support 106/trigger 107.

The sear 104 includes a sear body 104*a* (FIGS. 3C and 3D), and the sear support 106/trigger 107 includes a trigger body 107*a* (FIGS. 3A and 3B). The sear support 106/trigger 107 is configured with a sear engagement surface 115*b* and the sear body 104*a* is configured with a primary engagement surface 115*a* that overlappingly contacts/engages surface 115*b* when the fire control 100 is in the cocked condition (FIGS. 3A-3F). The amount of overlap between these engagement faces or surfaces comprises the primary engagement 115 (FIG. 3F). The sear 104 is held in its cocked position by the primary engagement 115 between the sear 104 and the sear support 106/trigger 107. The fire control 100 can, in some embodiments, be configured to provide a primary engagement 115 condition that does not require reliance on the trigger pull/reset spring system 112 to urge the sear support 106/trigger 107 to cooperatively form the primary engagement 115 with the sear 104 and hold the cocking piece 102 in a ready to fire/cocked position (FIG. 2A). With embodiments of the fire controls according to the principles of the present disclosure, when the sear 104 and sear support 106/trigger 107 are primarily engaged, the springs can be removed, and the fire control 100 will stay cocked until the trigger 107 is pulled a distance sufficient to clear the primary engagement 115 between the sear 104 and sear support 106 (FIG. 2B), whereupon the sear 104 moves to a discharged or decocked position, enabling the movement of the cocking piece 102 and firing pin assembly from the cocked position to the discharged position, enabling the firearm to discharge a loaded ammunition cartridge.

Sear override trigger mechanisms 20, such as the fire control 100, are discharged from the cocked condition by displacing the sear support 106 (embodied as trigger 107) such that the primary engagement 115 is severed, by applying a sufficient force to the trigger 107 (e.g. force executed by a user sufficient to overcome a trigger pull/reset spring force selected or set for the trigger) causes the sear support 106/trigger 107 to rotate (counterclockwise in FIGS. 2A and 2B) and disengage with the sear 104. When the sear 104 is no longer supported by the sear support 106 (the primary engagement surface 115*a* and sear engagement surface 115*b* no longer contact each other in an overlapping condition), the sear 104 is forced down (counterclockwise in FIGS. 2A and 2B) by the cocking piece 102, allowing the firing pin/striker assembly to travel forward and discharge the chambered round of ammunition.

Figures 4A, 4B, 4C, 4D, 4E:
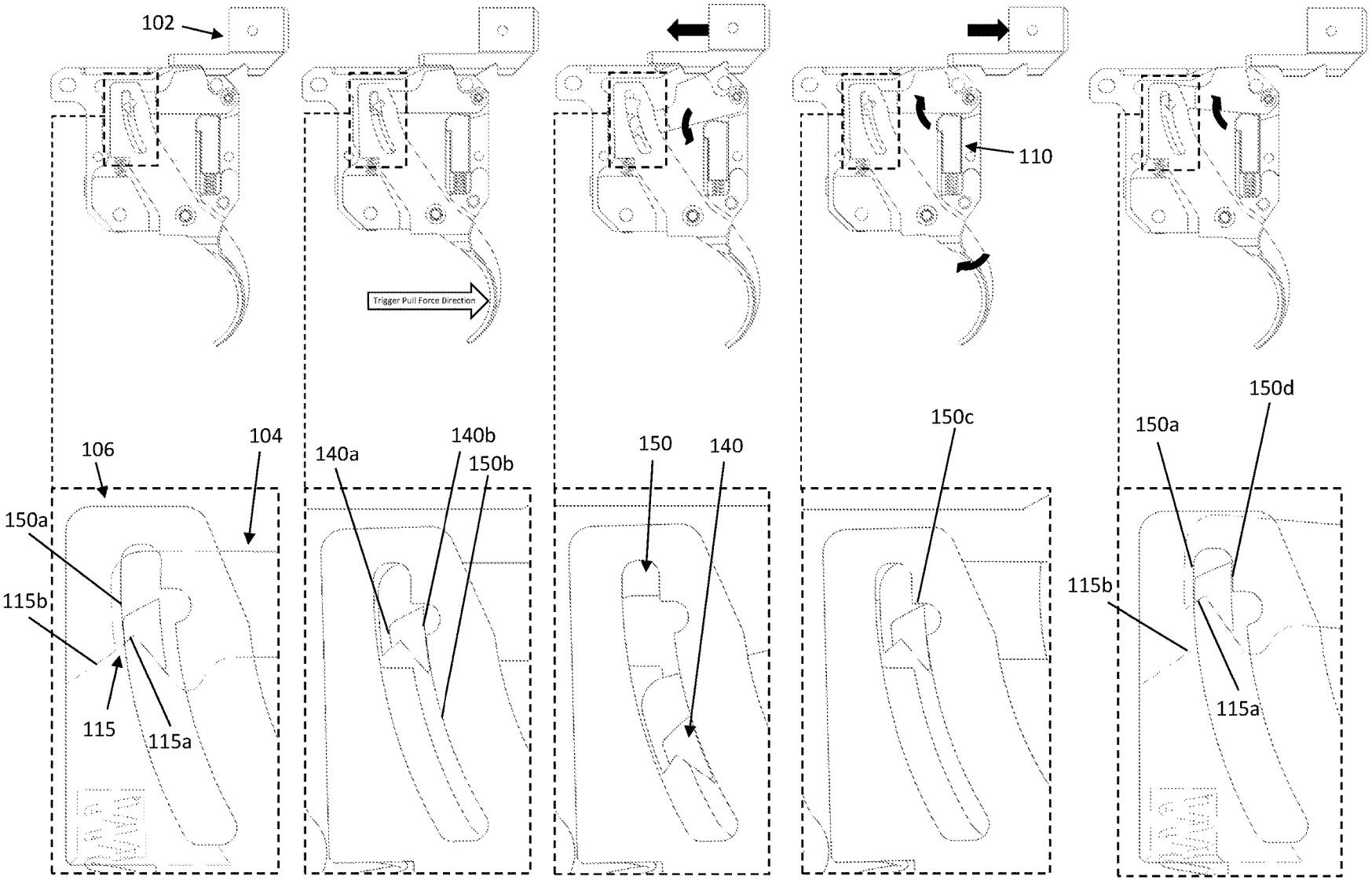
FIGS. 4A-4E depict a sequence of operations of the sear, sear support and cocking piece when the trigger of the fire control/trigger mechanism of FIGS. 2A and 2B is moved to a discharge position and the cocking piece is discharged and then retracted, according to embodiments of the present disclosure.

The sear body 104 and sear support 106/trigger 107 are reset from their respective discharged positions to their reset positions (whereby the primary engagement surface 115*a* and sear engagement surface 115*b* are configured in an overlapping position and facilitating the reestablishment of the primary engagement 115) by application of a loading force by springs urging the sear 104 and sear support 106 to displaced from their discharge positions (FIGS. 2B and 4C) to their reset positions (FIG. 4E) when the cocking piece 102 is cycled/reset. FIGS. 3G and 3H depicts a sear support reset system 130 that does not require the presence of the trigger pull/reset spring system 112 to reset the sear support 106/trigger 107 and is actuated by the upward/reset motion of the sear 104. Specifically, the sear support reset system 130 comprises a sear body 104*a* configured with an active sear support reset geometry 130*a* that cooperatively mates with the passive sear support reset geometry 130*b* integral to the sear support body 106*a*. The active sear support reset geometry 130*a* contacts the passive sear support reset geometry 130*b* and promotes motion of the sear support 106 to its reset position via motion of the active sear support reset geometry 130*a* against and along cooperative surfaces of the passive sear support reset geometry 130*b*. Therefore, when the sear 104 is displaced from its discharged position to its reset position (whereby its primary engagement surface 115*a* is above the sear engagement surface 115*b*) by operation of an external loading force applied by the movement of the cocking piece 102 rearwardly such that its sear loading surface 102*a* fully disengages the sear body 104*a* (as indicated in FIGS. 4D-4E), the sear reset spring system 110 raises the sear and the sear support reset system 130 mechanically displaces the sear support 106/trigger 107 from its discharged position (FIG. 4C) to its reset position (FIG. 4E), causing the sear's primary engagement surface 115*a* and sear support's sear engagement surface 115*b* to overlap. Whereby, when the sear 104 and the sear support 106 are in their respective reset positions and the sear loading surface 102*a* of the cocking piece 102 loads the secondary engagement surface 104*b* of the sear 104, the sear 104 is displaced from its reset position to its cocked position, i.e., the primary engagement surface 115*a* of sear 104 will make contact/engage the sear engagement surface 115*b* of the sear support 106.

By employing the sear support reset system 130, the complete dependency on the trigger pull/reset spring system 112 to reset the sear support 106 from its discharged position to its reset position after each discharge of the firearm is eliminated. The forces produced by the trigger pull/reset system 112 effectively only serve to increase the forces actively resetting the sear support 106 and enhancing the trigger mechanism 100's robustness with respect to withstanding the adverse effects imposed by the presence of field debris. Furthermore, when the sear 104 is loaded by the cocking piece 102 and the primary engagement 115 is made, the sear support reset system is no longer applying reset forces to the sear support, allowing the trigger to be pulled/displaced with forces commensurate with the trigger pull/reset spring system 112. In short, the sear support reset system 130 increases the reset forces applied to reset the sear support 106 without directly increasing the force required to displace/pull the trigger 107 and discharge the firearm. Practically, this translates into an increase in resistance to the effects of field debris inflicted by harsh environments, above and beyond the traditional approach of increasing the spring force of the trigger pull/reset spring system 112 and the accompanying increase in trigger displacement/pull force.

By way of example, and without limitation, combat is possibly the most extreme and abusive environment for a firearm, subjecting firearms to weather, dirt, sand and other debris, as well as other abuses or shocks, and it is not uncommon for military fire controls to have a heavier trigger pull/displacement than their civilian fire control counter parts. With the fire control equipped with a sear support reset system 130, a ten-pound sear reset spring system 110 may provide a sear lift/reset force of about ten-pounds while significantly increasing the forces acting to reset the sear support at the same time. When the bolt of the firearm 10 is retracted and the cocking piece 102 completely unloads sear 104, the sear 104 will rise due to the ten-pound (or other sear reset force) sear reset spring force and cause the sear support reset cam 140 to cam the sear support 106/trigger 107 back to its reset position and under the sear 104, such that, when the sear 104 is once again forced down by the cocking piece 102, the sear 104 and sear support 106/trigger 107 will engage each other. In this way the interaction between the sear 104 raising and the sear support 106/trigger 107 resetting serves to enhance or increase the trigger reset force beyond that provided by the trigger pull/reset spring system 112. Thus, a ten-pound sear reset spring can be utilized to reset the sear 104 and significantly increase the forces acting to reset the sear support 106/trigger 107 without increasing the associated trigger pull/displacement force, essentially allowing the fire control 100 to have a three-pound trigger pull/displacement force with a sear support 106/trigger 107 reset force equivalent to or great than a traditional military fire control equipped with a five-pound trigger pull/displacement force.

Components of the sear support reset system 130, in some embodiments such as depicted in FIGS. 3E-4E, may include a sear 104 equipped with a primary engagement surface 115*a*; and a passive sear support reset geometry 130*a*, which, in embodiments, can comprise a sear support reset cam 140 configured with a primary engagement limiting surface 140*a* and an over travel limiting surface 140*b*; the sear support 106 (embodied as the trigger 107) is configured with a primary engagement surface 115*b* and a reset geometry, shown here in one embodiment as including a sear support reset channel 150 configured with a sear support engagement limiting surface 150*a*, a sear support over travel limiting surface 150*b*, a sear support reset surface 150*c*, and a sear support holding surface 150*d*. As illustrated, the primary engagement 115 and the sear support reset system 130 of the sear 104 and sear support 106/trigger 107 have been split into functional halves. The right side of the sear 104 and sear support 106/trigger 107 contain the primary engagement 115 (FIGS. 3E and 3F). The left side of the sear 104 and sear support 106 contain the sear reset system 130 (FIGS. 3G and 3H) containing the sear support reset cam 140 (located on the sear 104) and the sear support reset channel 150 (located along the sear support 106).

FIGS. 4A-4E depict one embodiment of a sequence of how the function of the sear support reset system 130 is driven by the motion of the sear 104. In FIG. 4A the cocking piece 102 is shown loading the sear 104 with a force that is urging the cocking piece 102 to travel towards the right side of FIG. 4A. The loading of the sear 104 by the cocking piece 102 causes the sear 104 to rotate in a counterclockwise motion and promotes contact/engagement between the sear 104's primary engagement surface 115*a* and the sear support 106's sear engagement surface 115*b*. The amount of overlap/engagement between the primary engagement surfaces 115*a* and sear engagement surface 115*b* is limited by the sear support reset cam 140's engagement limiting surface 140*a* contacting the sear support engagement limiting surface 150*a* (FIG. 4A). In FIG. 4B a trigger pull/displacement force is shown being applied to the trigger 107, which causes a counterclockwise motion of the sear support 106/trigger 107, disengaging the sear engagement surface 115*b* of the sear support 106 out from under from the primary engagement surface 115*a* of sear 104 and severing the engagement 115.

The sear support reset channel 150's over travel limiting surface 150*b* functions cooperatively with the sear reset cam 140 to allow the sear support 106/trigger 107 to rotate beyond the limits of the primary engagement 115 such that its sear engagement surface 115*b* can move past the sear 104's primary engagement surface 115*b* and causes the sear 104 to become unsupported. When the trigger 107 is fully pulled, the rotation of the trigger 107 is stopped by the over travel limiting surface 140*b* contacting the sear support over travel limiting surface 150*b*. If the sear 104 is loaded by the cocking piece 102 and is unsupported by the sear support 106/trigger 107 (cocked and the trigger 107 is pulled, as depicted in FIG. 4B) the cocking piece 102 will override the sear 104 and rotate the sear 104 in a counterclockwise direction as the cocking piece 102 travers to the right (FIG. 4C). This counterclockwise rotation of the sear 104 causes the sear support reset cam 140 to traverse down the sear support reset channel 150.

After the fire control 100 has been "triggered", the fire control's components will remain in their respective discharge positions, as shown in FIG. 4C, until the cocking piece 102 is moved to far enough to the right to completely unload the sear 104 and allow the sear reset spring system 110 to displace/rotate the sear 104 clockwise to its reset position, as seen in FIG. 4E. Displacing the sear 104 from its discharge position to its reset position causes the sear reset cam 140 to travel up the sear support reset channel 150, as shown in FIGS. 4D and 4E. As the sear support reset cam 140 travels up the sear support reset channel 150, the sear support reset cam 140 will contact the sear support reset surface 150*c* if the rotation of the sear support is impeded. Contact between the sear support reset cam 140 and the sear support reset surface 150*c* clockwise moment/torque about the sear support 106 that urges the sear support 106 rotate to its reset position and create an overlap condition between the primary engagement surface 115*a* and the sear engagement surface 115*b*, as shown in FIG. 4E. Once the sear support 106 has been fully displaced to its reset position, it is held in the fully reset position as long as the sear support reset cam 140 is positioned between the sear support engagement limiting surface 150*a* and the sear support holding surface 150*d*, as shown in FIG. 4E.

In certain traditional fire controls/trigger mechanisms that are subjected to abuse, including extreme abuse cases where a firearm is jarred via a drop or impact of sufficient energy to temporarily displace the components of the fire control/trigger mechanism, the primary engagement 115 may become compromised. Under such extreme conditions it may be possible for the cocking piece 102 to unload the sear 104 and/or the internal components of the fire control to "bounce" off each other. In a fire control equipped with a sear support reset system 130, if the primary engagement surface 115*a* of the sear 104 "bounces" off the sear engagement surface 115*b* of the sear support 106, the sear support reset cam 140 may be driven up between the sear support engagement limiting surface 150*a* and the sear support holding surface 150*d* by the clockwise rotation of the sear 104 induced by the "bounce". This clockwise rotation of the sear 104, causes the sear reset cam 140 to cooperatively engage the sear support reset channel 150 and maintain the overlap between the primary engagement surface 115*a* and the sear engagement surface 115*b* (the sear support 106 is held in its reset position) and the primary engagement 115 to be reconstituted when the sear 104 is again loaded by the cocking piece 102. In this way, fire controls/trigger mechanisms equipped with a sear support reset system 130 may be more robust against abuse in the form of impacts.

The sear support 106 can be configured with the passive sear support reset cam follower surfaces located on the body of the sear support 106, and not on the interior surfaces of a channel. One such embodiment has the surfaces of the passive sear support reset cam follower on the forward most end (side furthest to the left in FIGS. 2A and 2B) of the sear support and is cooperatively engaged by a sear support reset cam projection located on the end of the sear.

FIGS. 5A-5D depict additional aspects of a sear override trigger mechanism 20, which, in the illustrated embodiment can comprise a two-stage fire control 200. The user difference between a single-stage and a two-stage fire control is the force that must be applied to displace the trigger and the total distance the trigger must be displaced to achieve discharge. In a two-stage fire control the trigger's displacement from its reset position to its discharged (fully pulled) position is divided into two stages. The trigger displacement of the first stage is typically longer than the displacement of the second stage, and when transitioning from the first stage to the second stage, the peak trigger pull/displacement force required to displace the trigger in the second stage is typically higher than the peak trigger pull/displacement force of the first stage. Two-stage fire controls are commonly employed to enable the operator to have greater precision when discharging a firearm. For example, a two-stage fire control of a military sniper rifle may be configured with a first stage having a trigger pull/displacement force of four pounds and the second stage having an incremental trigger pull/displacement force of one pound, yielding a total trigger pull/displacement force of five pounds (the peak trigger pull/displacement force of the second stage). The operator can pull the trigger through the first stage (four-pounds) and feel when the trigger stops at the beginning of the second stage. Because an additional one-pound of force will be required to further displace the trigger, the operator only needs to apply one-pound of additional trigger force to discharge the fire control. Typically, the smaller the force change required in the operator's hand to transition from holding to make a shot to completing the trigger pull and making the shout results less unintended displacement of the firearm, yielding more accurate shots. When operating a single stage trigger employing a five-pound trigger pull, the operator only has his or her training to rely on to tell the difference between preloading the trigger and pulling the trigger to discharge the fire control.

As illustrated, the two-stage fire control 200 (FIG. 5A) generally will have many of substantially the same parts as the single-stage fire control 100, with the exception of the trigger 208 and the sear support; rather, in the present embodiment, a connector 207 is provided as a linkage between the trigger 208 and the sear 104, and supports the sear when in its cocked or ready-to-fire position. The connector 207 further comprises an alternate embodiment of a sear support in place of the sear support 106 defined by the trigger 107 used in fire control 100 (FIGS. 2A-4E). The trigger mechanisms/fire controls 100 and 200 further can share common housings or support plates 101, a cocking piece 102, a sear 104, a sear support 106 (embodied as a connector 207), and a sear reset spring system 110. In addition, a safety arm 108 is further illustrated in FIG. 5A, on one side of the housing, as discussed below. When cocked, the firing pin assembly is held in the cocked position via the cocking piece 102 engaging the sear 104. The cocking piece 102 is part of the firing pin assembly. When cocked, the sear 104 is held in place by the sear support 106/connector 207, just as it was in the single stage fire control 100 shown in FIGS. 2A-4E. The sear support reset system 130 of this embodiment also functions as it did in the embodiment of fire control 100.

For clarification purposes, trigger of a single-stage fire control and a connector of a two-stage fire control are both forms of a sear support. The trigger 107 of fire control 100 is a sear support 107 configured with the sear engagement surface 115*b* and sear reset geometry 130*b* along the first end of the sear support body 106*a*; and a trigger bow configured along the second end of the sear support body 106*a*. The connector 207 of the fire control 200 is a sear support 107 configured with the sear engagement surface 115*b*, a sear reset geometry 130*b* and a trigger primary engagement surface 207*a* along the first end of the sear support body

106*a*; and a trigger secondary engagement surface 207*b* configured along the second end of the sear support body 106*a*. The sear engagement surface 115*b* and the sear support reset geometry 130*b* can be common between the trigger 107 and the connector 207 and therefore, interact with the primary engagement surface 115*a* and sear support reset geometry 130*a* of the sear 104 in the same manner, i.e. the primary engagement 115 and sear support reset geometry 130 function in the same manner in fire control 100 and fire control 200.

In embodiments depicted in FIGS. 5A-5D, the trigger 208 is equipped with a connector blocking feature that mechanical blocks the connector 207 from rotating in the discharge direction unless the trigger 208 has been pulled/rotated at least partially through the first stage. The connector blocking feature 250 is comprised of a connector blocking surface 250*a* located on the trigger 208 and a trigger secondary engagement surface 250*b* located on the connector 207. If the trigger 208 is in its reset position and the sear support 106/connector 207 is urged to rotate, the trigger secondary engagement surface 250*b* will impact/contact the connector blocking surface 250*a*, preventing the connector 207 from rotating. When the connector 207 is prevented from rotating, engagement between the primary engagement surface 115*a* of the sear 104 and the sear engagement surface 115*b* of the sear support 106/connector 207 is assured and the sear 104 is supported in the cocked position. Typically, two-stage fire controls do not have a blocking feature that directly prevents the connector from rotating unless the trigger has been at least partially pulled/displaced through the first stage.

Figure 5A:
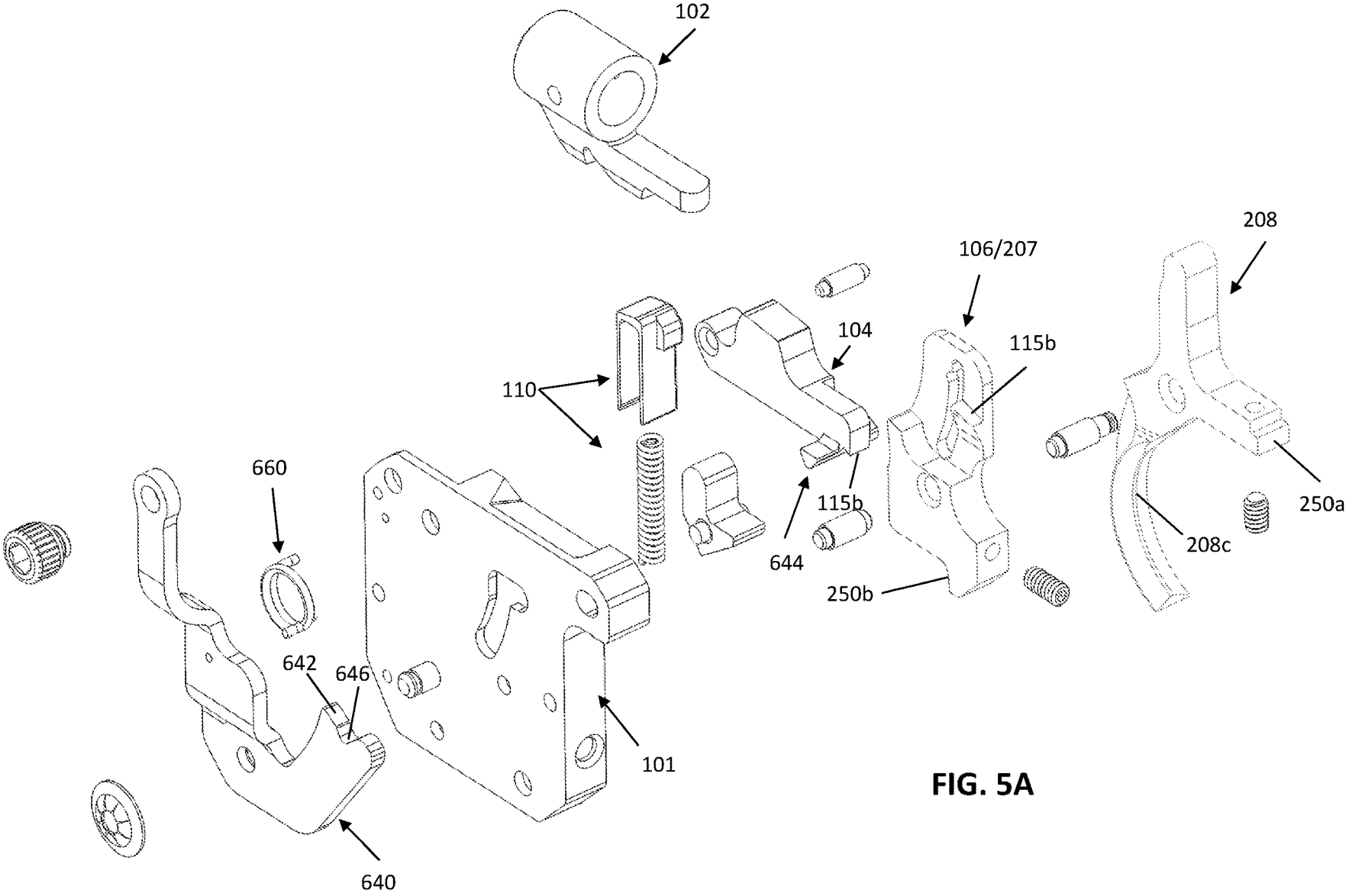
FIG. 5A depicts an exploded view of a two-stage, sear override fire control/trigger mechanism, according to embodiments of the present disclosure.
Figure 5D:
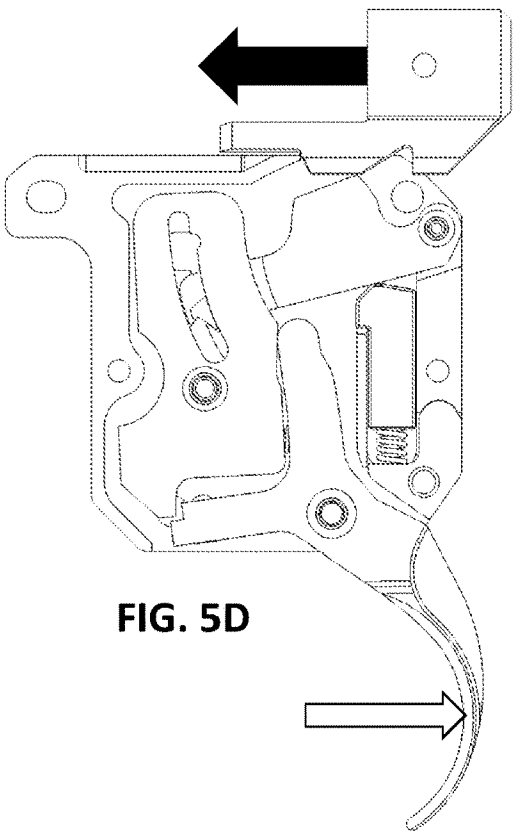
FIGS. 5B-5D depict a sequence of operation of the two-stage, sear override fire control/trigger mechanism of FIG. 5A and the cocking piece when the trigger is pulled from the cocked condition, according to embodiments of the present disclosure.
Figure 5C:
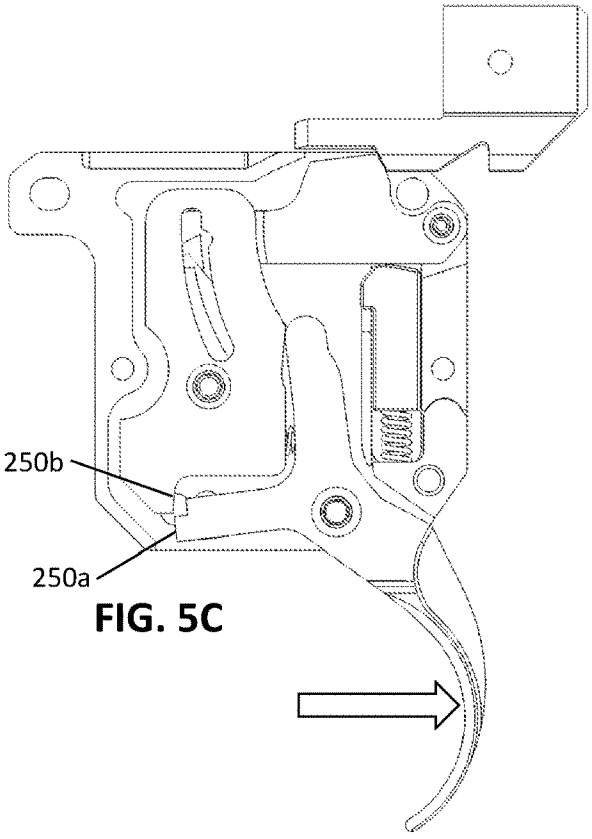
Figure 5B:
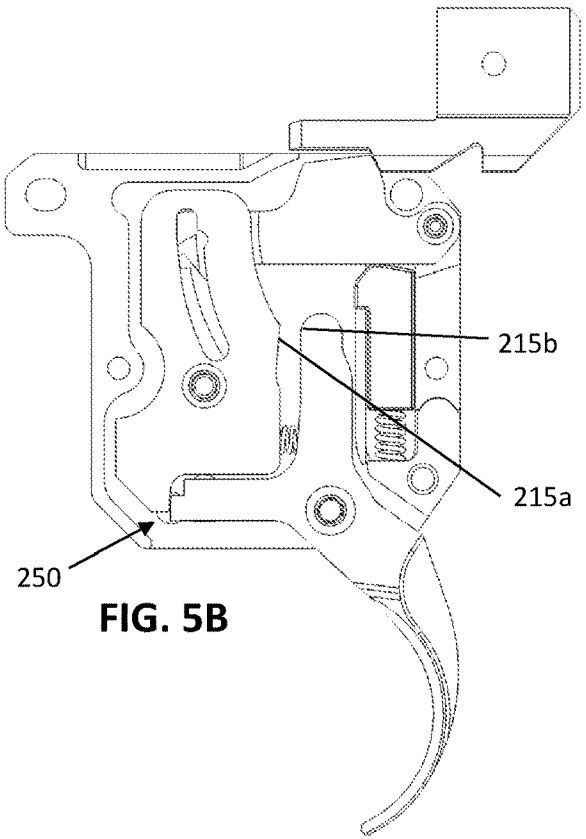
Figure 6C:
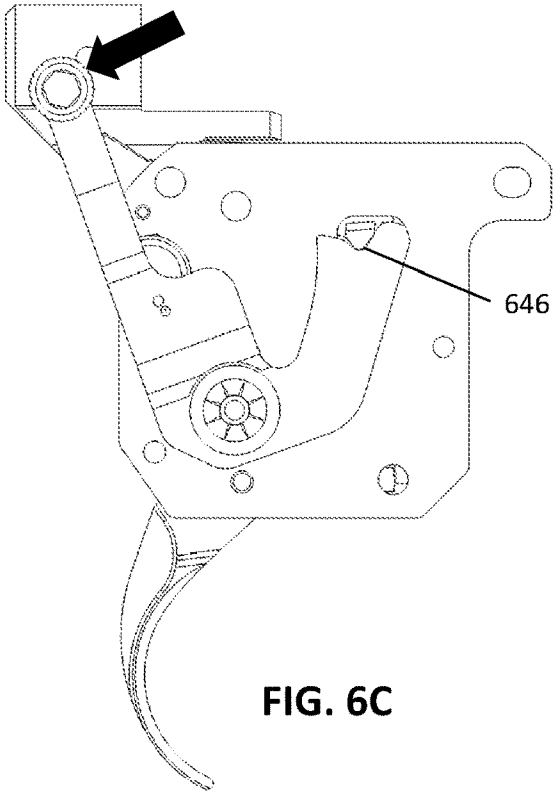
FIGS. 6A-6C depict a safety arm configured with a sear reset and blocking cam when the safety is in the "On/Safe" position, according to embodiments of the present disclosure.
Figure 6B:
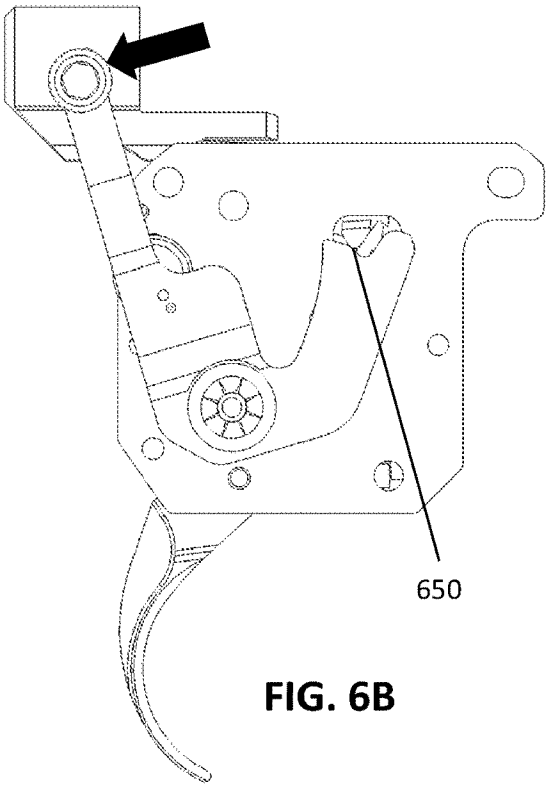
Figure 6A:
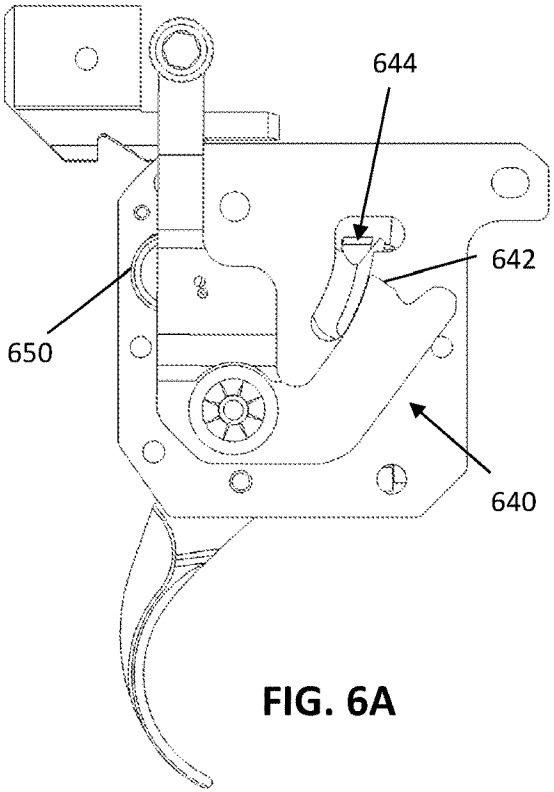
Figure 6E:
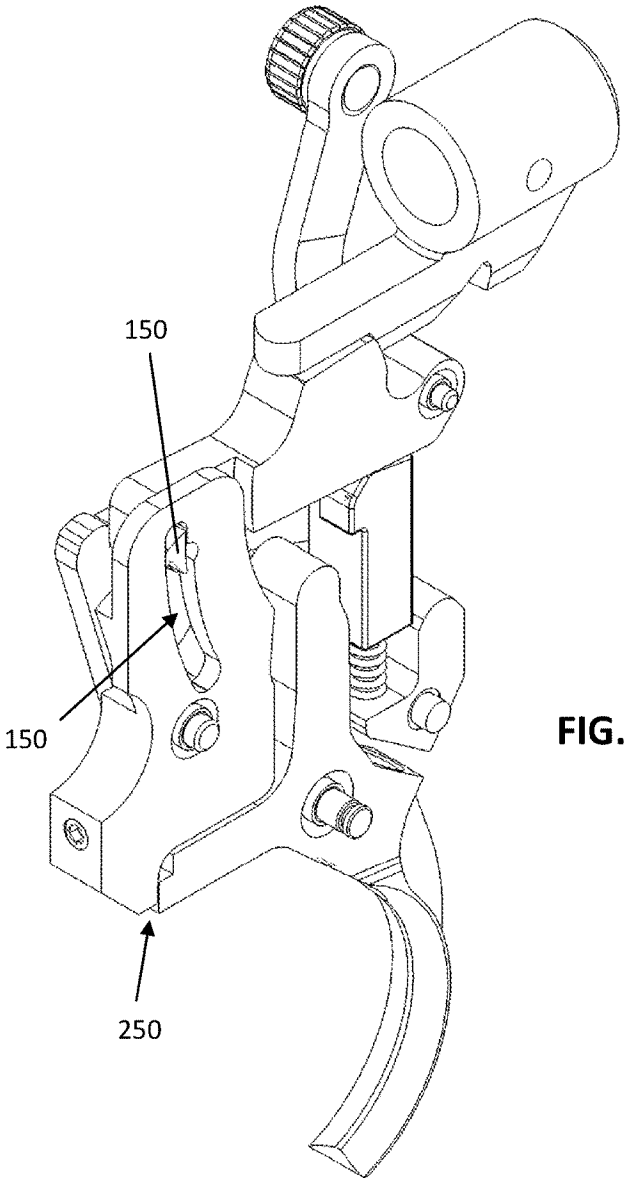
FIGS. 6D and 6E are isometric views depicting a sear override fire control/trigger mechanism equipped with a sear reset and blocking safety arm that causes the sear and sear support to be displaced to their respective reset positions when the safety is in the "On/Safe" position, according to principles of the present disclosure.
Figure 6D:
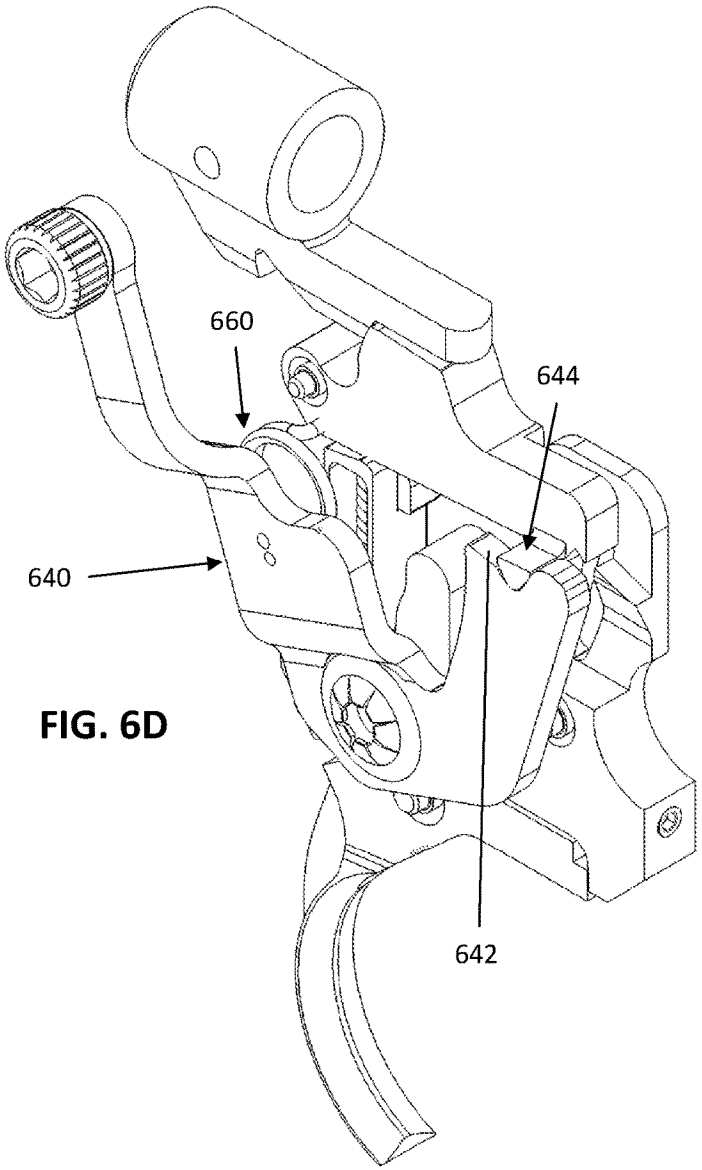

Applying sufficient force to the trigger bow 208*c* of trigger 208 will cause trigger 208 to rotate (counterclockwise in FIGS. 5B-5D). FIG. 5B shows the trigger 208 in its initial/reset position. The rotation of trigger 208 from its reset position to the point where the trigger 208 contacts the connector 207 is called the first stage of the trigger pull. Rotation of the trigger 208 from its contact position with the connector 207 (FIG. 5C) to where it displaces connector 207 to where the primary engagement 115 is severed is called the second stage of the trigger pull. This second stage of the trigger 208 motion causes the fire control's sear 104 to be unsupported and release the cocking piece 102 and the two-stage fire control 200 to allow the firearm to discharge.

When the sear 104 is no longer supported by the connector 207, the sear 104 is forced down by the cocking piece 102, allowing the firing pin assembly to travel forward and discharge the chambered round of ammunition.

Additionally, some embodiments of two-stage fire control/trigger mechanisms may be configured with a trigger blade configuration. A trigger blade is a secondary trigger bow pivotally mounted to the trigger 208's trigger bow 208*c*. Displacing the trigger blade via the operator's trigger finger caused the trigger blade to rotate onto or into the trigger bow 208*c*, then allowing the operator's trigger finger to press against and displace the trigger bow 208*c*. A trigger blade could be constructed that would facilitate blocking of the connector via the trigger blade, i.e., the connector blocking surface 250*a* would be located on the body of the trigger blade. In these embodiments, a trigger blade may be disposed within the trigger and extend from the trigger, such that the trigger cannot displace the connector unless the trigger blade is pulled first.

FIGS. 6A-6E depict components of a sear override fire control/trigger mechanism 600 that has a safety arm 640 configured with a system reset geometry, according to embodiments described herein. By way of example, as illustrated, the fire control/trigger mechanism 600 can comprise a two-stage fire control/trigger mechanism such as discussed above with respect to FIGS. 5A-5D, including a cocking piece 102, a sear 104, a trigger 208, a sear support 106/connector 207, and a safety arm 640. The sear 104 of this embodiment further may include a safety cam follower 644 for engaging with one or more safety cam surfaces 642 of the safety arm 640.

Accordingly, these embodiments may be configured to mechanically reset the fire control 600 via the safety arm 640, even if the sear 104 is stuck in the discharged position. The sear 104 may be equipped with a safety cam follower 644 that engages with a corresponding cam feature on the safety arm 640. As the safety arm 640 is rotated from the "Off/Fire" position to the "On/Safe" position, the safety arm 640 and cam follower surfaces on the sear 104 interact to rotate and lock sear 104 to its reset position and correspondingly lock the sear support 106/connector 208 in its reset position via the sear support reset system 130.

Traditionally, when the sear 104 is in the discharged position, the sear 104 cannot be raised from a jammed down position without disassembling the fire control of those embodiments. The safety arm of fire control 600 embodiments described herein can be configured to raise the sear 104 from a jammed down position via rotating the safety arm 640 from the "Off/Fire" position to the "On/Safe" position. Additionally, some embodiments may be configured such that the safety arm 640 interacts with an intermediate piece that raises the sear 104 when the safety arm 640 is rotated from the "Off/Fire" position to the "On/Safe" position. As the safety arm 640 directly or indirectly raises the sear 104, the safety cam follower 644 features of the sear 104 mechanically reset the sear support 106/connector 207/trigger 107 (single-stage or two-stage dependent) as the sear 104 is fully raised. When the safety arm 640 is in the "On/Safe" position, the sear's safety cam follower 644 rests in a detent surface 646 in the cam surface of the safety arm 640. Each time the safety arm 640 is rotated from the "Safe" position to the "Fire" position, the sear's safety cam follower 644 rides up and out of the detent surface 646 in the safety cam 642 of the safety arm 640, causing the sear 104 to rise and mechanically reset the sear support 106/connector 207/trigger 107. If the operator is physically strong enough to cycle the safety arm 640 of the firearm, the sear 104 may be reset, which in turn mechanically resets the sear support 106/connector 207/trigger 107. In such a way a soldier could clear a jammed firearm and return it to active duty in an extreme environment.

Because the safety arm 640 of fire control 600 employs a detent system comprised of a detent spring 660 and the detent surface 646 to bias the safety arm 640 in the "On/Safe" or "Off/Fire" position, the operation of the safety arm 640 has a null/balance point 650 between its two biased positions. Matching the highest displacement area of the safety cam 642 with the null/balance point 650 of the safety arm 640's operation, the sear 104 will be placed in its full reset position if the safety arm 640 becomes balanced in its null position. Correspondingly, each time the safety arm 640 is switched from one bias position to the other ("Safe" to "Fire" or "Fire" to "Safe"), the safety arm will pass through its full reset position.

Figure 7A:
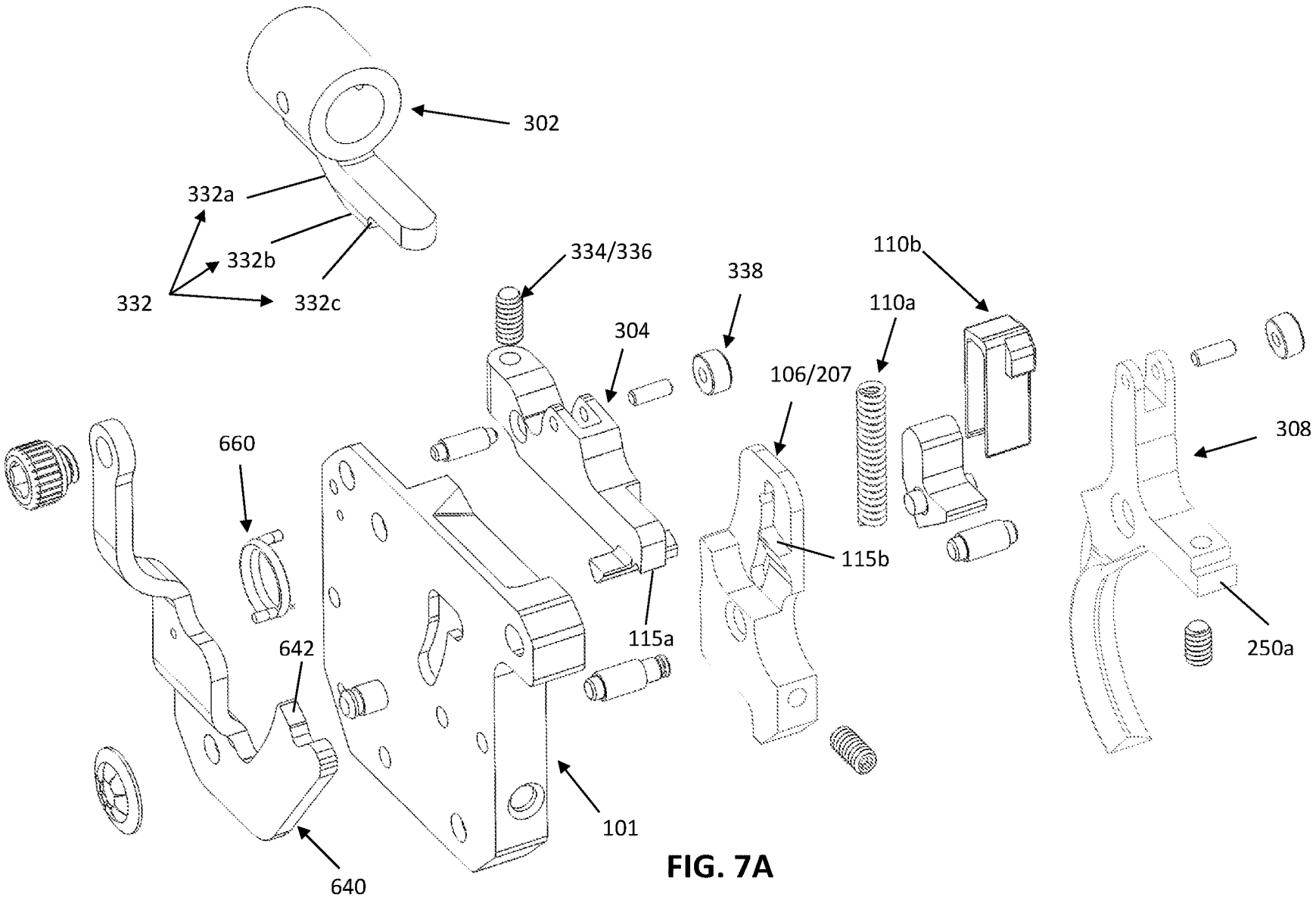
FIG. 7A depicts an exploded view of a two-stage, sear override fire control/trigger mechanism configured with rolling contacts between the trigger and sear support and between the sear and cocking piece, and sear reset cam and cam follower configured on the sear and cocking piece, according to embodiments of the present disclosure.
Figure 7C:
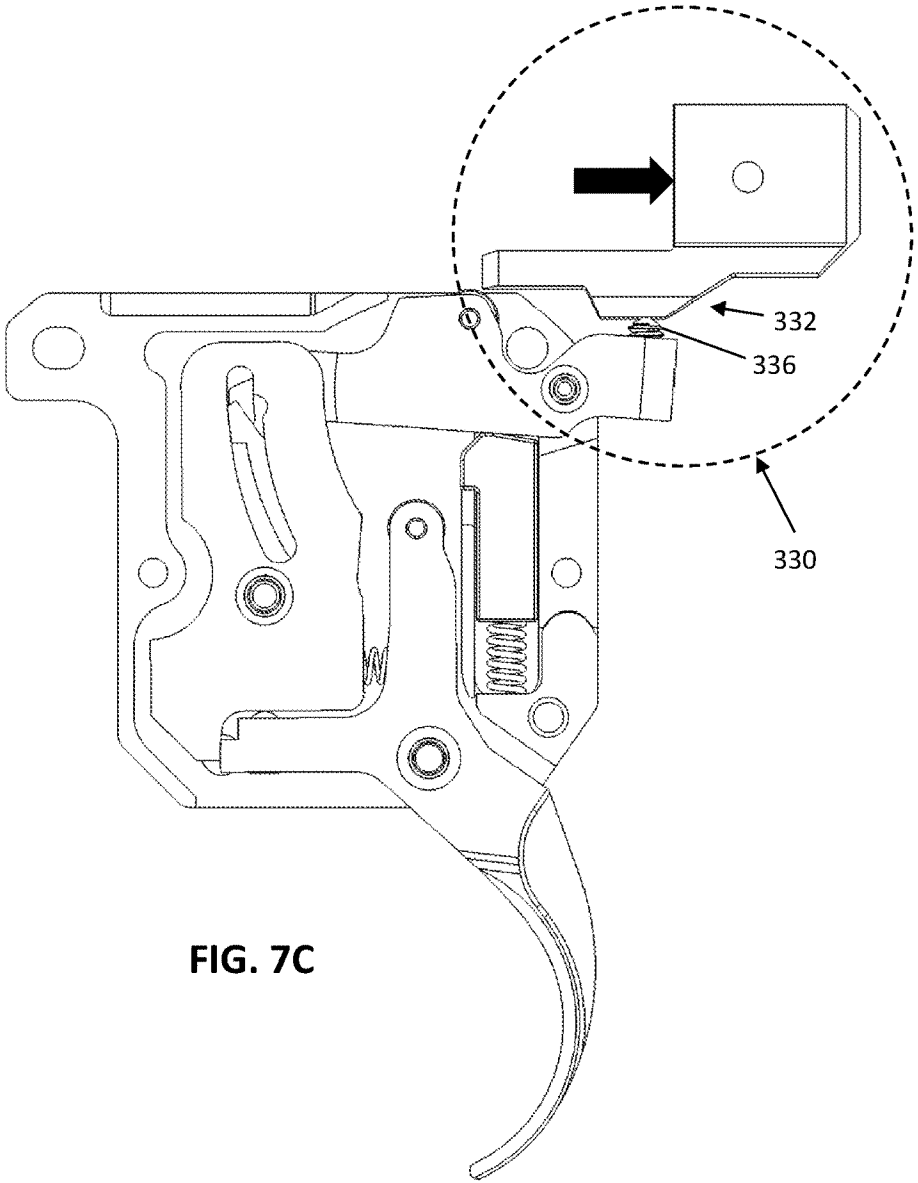
FIGS. 7B and 7C depict side views of a mechanical sear reset system of a sear override fire control/trigger mechanism that is actuated by the motion of the cocking piece, according to embodiments of the present disclosure.
Figure 7B:
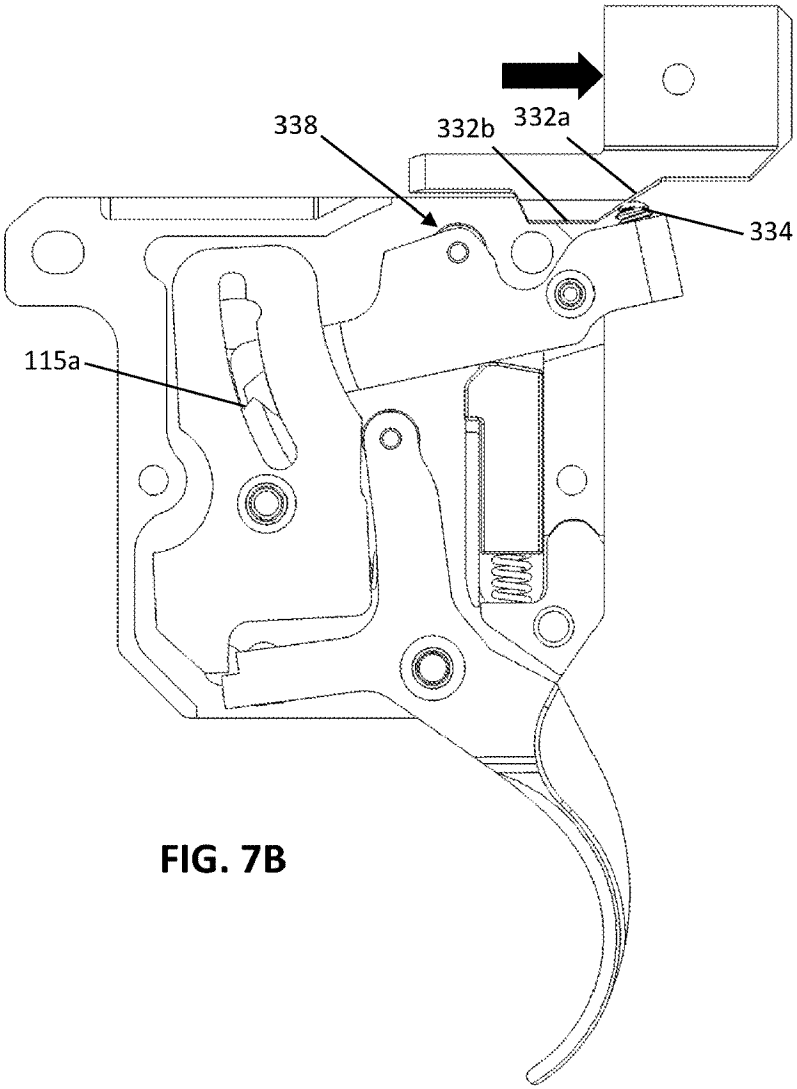

FIGS. 7A-7C depict a sear override fire control/trigger mechanism 300 configured with a sear reset system 330 that has a sear 304 equipped with a sear reset cam follower 334, according to embodiments described herein. As illustrated, the fire control 300 can be a two-stage fire control, although persons of skill in the art will understand that the features of the sear reset system 330 shown in FIGS. 7A-7C also can be used with a single-stage fire control and in traditional sear override fire controls (sear support override fire controls that do not employ sear support geometries of any kind). The fire control 300 includes a cocking piece 102, a sear 304, a sear reset cam follower 334, and a sear reset spring system 110. The cocking piece 102 may have a sear reset cam 332 for interacting with the sear reset cam follower 334 of the sear 304. In these embodiments, the fire control 300 may have been fired and the subsequently subjected to ice, mud, dirt, sand, etc., causing the fire control 300 to become jammed and prevent the sear reset spring system 110 from returning the sear 304 to its reset position. As such, the sear 304 is equipped with the sear reset follower 334, which interacts with the sear reset cam 332 on the cocking piece 302. The features of the sear reset system 330 can take many forms, the sear reset cam follower 334 of sear 304 is the sear reset screw 336. The sear reset cam 332 of the cocking piece 302 is a simple angled surface 302*a* on the underside of the cocking piece 302. Each time the cocking piece 302 is cycled (the bolt of a firearm 10 is opened and closed) and the sear reset cam 332 interacts with the reset screw 336 of the sear 304, mechanically displacing the sear reset screw 336 and correspondingly displacing the sear from its discharged position (FIG. 7B) to its reset position (FIG. 7A). FIG. 7B shows the sear in a jammed discharge position (unable to rise under spring force alone) and the cocking piece is being displaced rearward (the bolt of firearm 10 is being opened). In the embodiment shown, the sear reset screw 336 is threaded into the end of the sear 304 opposite its primary engagement surface 115*a*, allowing the reset function to be adjusted for manufacturing tolerances. When the cocking piece 302 is retracted by a user, the reset screw 336 interacts with the sear reset cam 332, which is configured as a cam surface 332*a*, 332*b* and 332*c* on the underside of the cocking piece 302, resetting the sear 304, which causes the sear support 106 to be reset via the sear support reset system 130. As such, the fire control 300 is forced back into its cocked position each time the cocking piece (bolt assembly of firearm 10) is fully cycled, thus allowing for a mechanical reset of the fire control 300 if extreme adverse environmental conditions prevent a normal reset of the fire control's components via the sear rest spring system 110. If the operator is physically strong enough to cycle the bolt of the firearm 10, the sear reset system 330 will reset the sear 304, which in turn will mechanically resets the sear support 106/connector 207/trigger 107. In such a way a soldier could clear a jammed firearm and return it to active duty in an extreme environment.

As also indicated in FIGS. 7A-7C, the sear 304 has a sear roller 338, according to embodiments described herein, and configured to reduce the impact of friction between the sear 304 and cocking piece 302 during the discharge process, improving the feel of the trigger on the operator's finger when pulling/displacing the trigger. In the illustrated embodiment, the secondary engagement surface on the sear is replaced with the roller 338 that contacts the cocking piece 302 and reduces friction between the cocking piece 302 and the sear 304. Typically, as the primary engagement between the sear 304 and sear support 106 is reduced/eliminated, the sear rotates up. This rotation of the sear 304 means the cocking piece 302 is pushed rearward and the secondary engagement surfaces between the sear 304 and cocking piece 302 must slide over each other. As indicated above, some embodiments may be configured such that the roller 338 is placed on the cocking piece 302 to accomplish a similar effect as placing the roller 338 on the sear 304.

Figure 8:
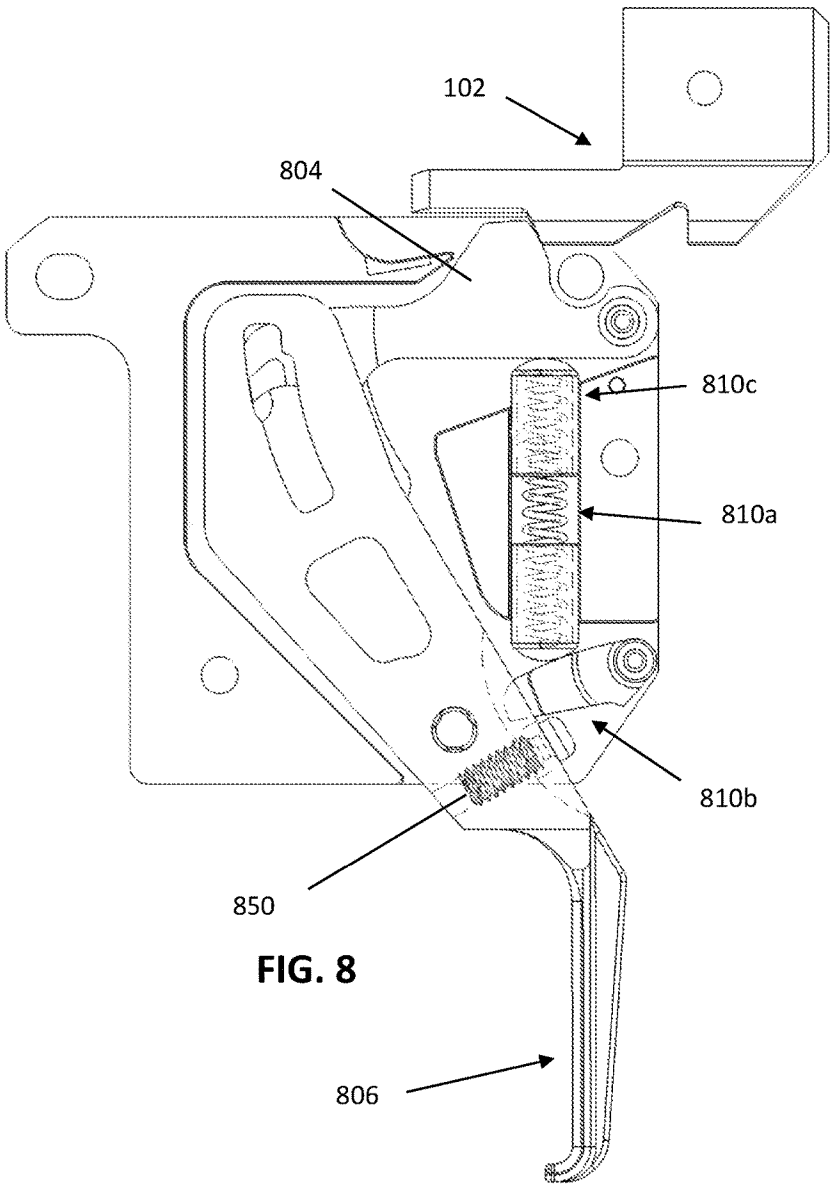
FIG. 8 depicts an embodiment of a fire control/trigger mechanism equipped with a sear support/trigger rest cam driven by the sear reset spring, according to principles of the present disclosure.

FIG. 8 depicts components of a sear override fire control/trigger mechanism 800 with a trigger pull adjustment screw 850, according to embodiments described herein. By way of example, the fire control/trigger 800 is shown as a single stage fire control/trigger mechanism (which can have a similar construction to the fire control/trigger mechanism 100 of FIGS. 2A-2B), including a cocking piece 802, a sear 804, a trigger 806, a sear return spring 810*a*, sear return spring guides 810*c* and 811*d*, a trigger pull cam 810*b*, and the trigger pull force adjustment screw 850. Accordingly, these embodiments may be configured to allow for a large range of trigger pull force adjustment via the trigger pull adjustment screw 850, which is user adjustable. Specifically, the trigger pull cam 810*b* is acted upon by a force supplied by sear reset spring.

The trigger pull adjustment screw 850 imbedded in the trigger 806 and interfaces with the trigger pull cam 810*b*. Adjusting the trigger pull adjustment screw's 850 amount of protrusion from the trigger 806 changes where the trigger pull adjustment screw 850 interfaces with the trigger pull cam 810*b* and changes the mechanical advantage of the trigger pull cam 810*b* and the resulting force applied to the trigger pull adjustment screw 850, changing the force required to displace the trigger 806. The trigger pull spring 810*a* induces a torque in the trigger pull cam 810*b*. The trigger pull adjustment screw 850 changes the length of the torque arm of the trigger pull cam 810*b*. Therefore, adjusting the force the shooter must overcome to pull the trigger 806. This allows for a greater range of trigger pull forces capable via the trigger pull adjustment screw 850 acting to compress the trigger pull spring 810*a* directly.

The trigger pull adjustment screw 850 is configured with a dome feature that prevents the trigger pull adjustment screw 850 from being turned out of the front of the trigger 806, the dome feature interferes with the body of the trigger 806 when over turned in one direction. Correspondingly, the dome feature of the trigger pull adjustment screw 850 interferes with a feature of the trigger pull cam 810*b* if over turned in the opposite direction. Limiting the adjustment of the trigger pull adjustment screw 850 in both directions prevents the trigger pull adjustment screw 850 from being removed from the fire control 800 via over adjusting the trigger pull adjustment screw 850.

Figures 9A, 9B:
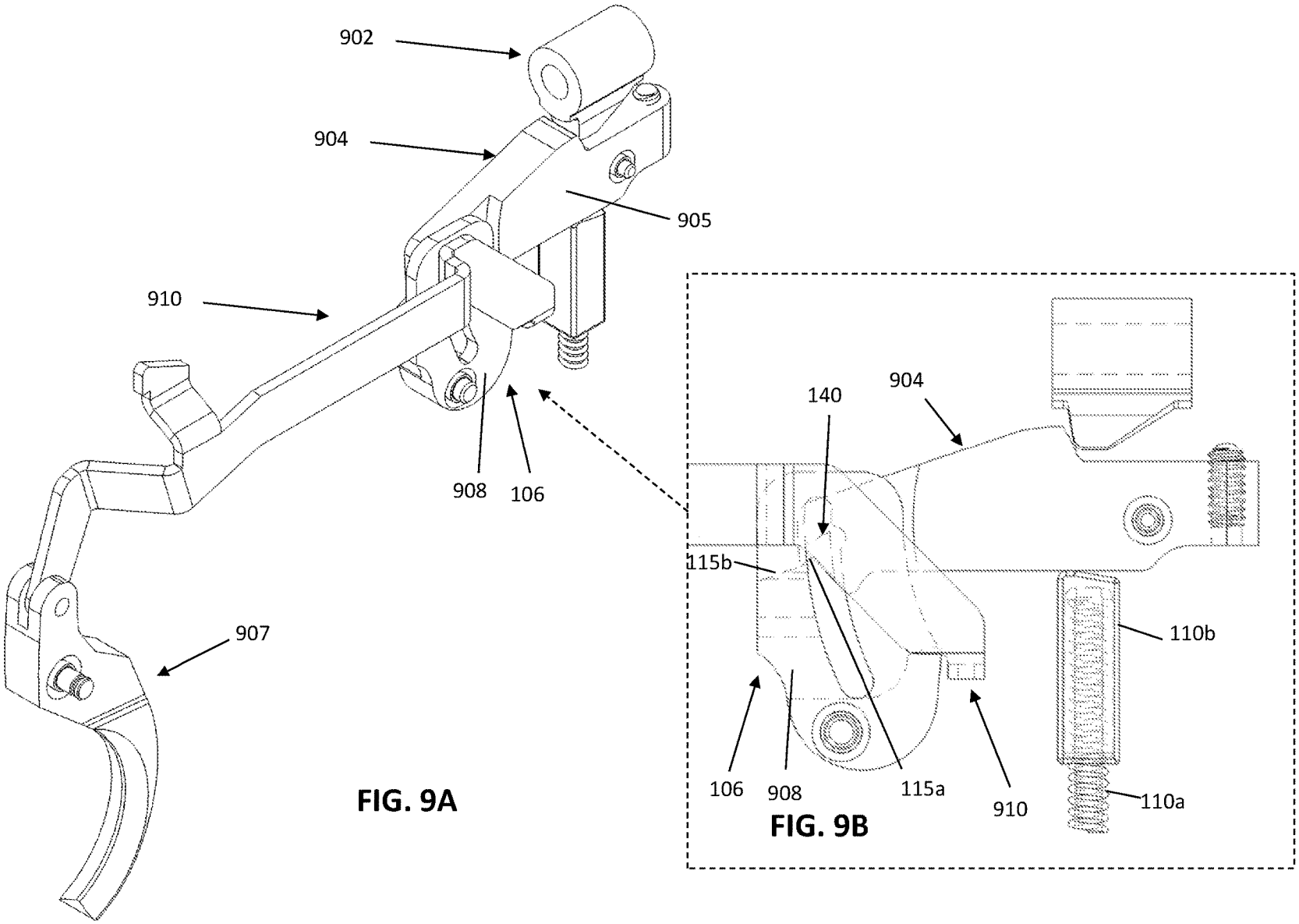
FIGS. 9A-9B depict a fire control/trigger mechanism with a sear engagement configured with an active sear support reset system and a passive sear reset system in accordance with the fire controls/trigger mechanisms of FIGS. 1-8, which can be used with a pistol or similar trigger activated device, according to embodiments of the present disclosure.

FIGS. 9A and 9B illustrates further aspects of the sear override fire control/trigger mechanism indicated at 900, which can include a sear engagement and override configured for use with a pistol, revolver, or other, similar trigger activated device. As illustrated in FIG. 9A, the fire control/trigger mechanism 900 includes a cocking piece 902 that is moveable between a forward, discharged position and a rearward, cocked or pre-discharge position in engagement with sear 904 so as to apply an external load or force against the sear when the sear is in an initial/rest, cocked or pre-discharge position. The sear 904 has a sear body 905 coupled in operative engagement to a sear support 106. The sear support 106 is operatively displaced via a trigger bar 910 pivotally attached to a trigger 907. In the present embodiment, the sear support can 906 is embodied as a connector 908, in similar fashion to a two-stage fire control such as discussed above with respect to FIGS. 5A-5D.

The sear support 106/connector 908 is shown configured with a sear engagement surface 115*b* configured to engage a corresponding or associated engagement surface 115*a* defined at a first or forward end of the body of the sear 904, as shown in FIG. 9B, so as to define an overlapped primary engagement 115 between the connector and the sear, such as discussed above. In addition, such as indicated at 918, and has a sear support reset geometry 130 defined along the second or distal end of the connector, and can include, for example, a sear support reset channel 150 configured to engage with a sear support reset cam 140 of the sear 904. The sear support reset cam channel 150 can be configured with one or more cam follower surfaces, including an engagement limiting surface 150*a*, an over travel limiting surface 150*b*, a sear support reset surface 150*c*, and a sear support holding surface 150*d*. The sear support reset cam 140 of the sear 904 can include a reset cam 941 that is formed along the first or forward end of the sear body and is configured to be received in the sear support rest channel 150 of the sear support 106/connector 908.

As further illustrated in FIG. 9B, a primary engagement surface 115*a* will be defined along an intermediate portion of the body 905 of the sear 904, and will be configured such that as the sear 904 is raised to its reset position, it will be overlap the corresponding sear engagement surface 115*b* of the cocking piece 902. A sear reset cam follower or adjustable reset member 336 also can be provided along the body of the sear adjacent the rear or second end thereof, in a position to be engaged by the rearward travel of the cocking piece 902 after firing to help urge or otherwise cause the sear 904 to rotate or move toward its reset position as shown in FIG. 9B. A sear reset spring 110*a* is positioned below the body of the sear 904, and includes at least one reset spring or similar biasing member 110*a*. The reset spring 110*a* can further be received within a recess of a housing or spring guide 110*b* that will be biased by the reset spring against the bottom surface of the body of the sear 904 so as to urge the sear 904 toward its reset position after discharge of the pistol.

When the trigger is fully pulled, the sear 904 is no longer supported and the cocking piece 902 is released, translating forwardly so as to cause firing of the pistol via the firing pin striking and detonating the primer of the chambered round of ammunition. Thereafter, as the cocking piece is released, it is allowed to override the sear and causes the sear 904 to rotate counterclockwise and the sear support reset cam 140 to traverse down the sear support reset channel 150. After fire control 900 has been "triggered", the fire control's components will remain in their discharged positions until the cocking piece is moved rearward far enough to clear the sear. When the sear 904 is no longer loaded by the cocking piece 902, the sear reset spring 110*a* will urge the sear 904 upward or in a clockwise rotation, causing the sear reset cam to traverse up the sear support reset channel until the sear's primary engagement surface 115*a* and the sear support's sear engagement surface 115*b* are reset to an overlapping condition.

If the connector 908/sear support 106 is not able to return freely to its reset position or the sear has been unloaded by the displacement of the cocking piece rearward, the sear support reset cam will impact the sear support reset surfaces of the sear support reset channel, creating a clockwise torque about the connector/sear support that will rotate the connector/sear support to its reset, cocked or pre-discharge position. Once the connector/sear support has been fully reset, it is held in the fully returned position while the sear is in its reset cocked or pre-discharge position, as the sear support reset cam is held between the sear return channel's engagement limiting surface and sear support holding surface.

The striker assemblies (firing pin assemblies) of semiautomatic pistol are traditionally housed in the slide of the pistol. Each time the pistol discharges, the slide is automatically cycled by the propellant gasses produced by the discharge of the ammunition. This cyclical action of the slide allows the sear 904 to be mechanically reset each time the pistol is discharged. Additionally, the sear reset cam can be moved from the cocking piece 902 to the slide of the pistol.

Practically, the sear reset cam is not required to be located on the cocking piece. The sear reset cam can be located on any part of the firearm that moves cyclically with respect to the discharge of the firearm, and is located proximally to the sear of the fire control. By way of example, the sear reset cam of firearm 10 can be moved from the cocking piece to the bolt body, as the bolt houses the cocking piece and is cycled (opened and closed) each time a round of ammunition is loaded into the chamber of the firearm.

As illustrated above, various embodiments for bolt action fire control are disclosed. These embodiments may be configured to reset a fire control that has jammed due to adverse environmental conditions, such as those experienced by military firearms in combat, without requiring a corresponding increase in the trigger pull force. These embodiments may also be configured to prevent a fire control from discharging due to physical abuse, such as severe impacts, without requiring a corresponding increase in the trigger pull force. Additionally, these embodiments may be configured to provide internal locking mechanisms and/or other features not currently provided in existing solutions. While the embodiments presented here in represent significant performance enhancements for military firearms, commercial firearms may also benefit from the performance enhancements presented.

While particular embodiments and aspects of the present disclosure have been illustrated and described herein, various other changes and modifications can be made without departing from the spirit and scope of the disclosure. Moreover, although various aspects have been described herein, such aspects need not be utilized in combination. Accordingly, it is therefore intended that the appended claims cover all such changes and modifications that are within the scope of the embodiments shown and described herein. It should also be understood that these embodiments are merely exemplary and are not intended to limit the scope of this disclosure.

What is claimed is:

1. A trigger mechanism, comprising:

a sear having a sear body comprising a primary engagement surface, a secondary engagement surface and a sear reset cam follower, and being moveable between a discharge position and a reset position; and a sear support including a sear support body having a sear engagement surface configured to engage the primary engagement surface of the sear body;

wherein a cocking piece external to the trigger mechanism and configured with at least one sear reset cam cooperatively engages the sear reset cam follower of the sear, and urges the sear to be displaced from a discharged position to a reset position as the cocking piece translates in a rearward direction away from the trigger mechanism each time the cocking piece is fully cycled.

2. A trigger mechanism, comprising:

a sear having a sear body comprising a primary engagement surface, a secondary engagement surface and a sear reset cam follower, and being moveable between a discharge position and a reset position; and a sear support including a sear support body having a sear engagement surface configured to engage the primary engagement surface of the sear body;

wherein a cocking piece external to the trigger mechanism and configured with at least one sear reset cam cooperatively engages the sear reset cam follower of the sear, and urges the sear to be displaced from a discharged position to a reset position as the cocking piece translates in a rearward direction away from the trigger mechanism; and wherein the sear reset cam follower of the sear comprises an adjustment screw which is received within the sear body and is configured with at least one surface that cooperatively engages a sear reset cam surface of the cocking piece, causing the sear to be displaced from the discharged position to the reset position each time the cocking piece is fully cycled.

3. A trigger mechanism, comprising:

a sear having a sear body comprising a primary engagement surface, a secondary engagement surface and a sear reset cam follower, and being moveable between a discharge position and a reset position; and a sear support including a sear support body having a sear engagement surface configured to engage the primary engagement surface of the sear body;

wherein at least one sear reset cam surface is defined along a reciprocating bolt assembly of a firearm and is configured to engage the sear reset cam follower of the sear upon a cycling movement of the reciprocating bolt assembly after each discharge of the trigger mechanism.

4. A trigger mechanism, comprising:

a sear having a sear body comprising a primary engagement surface, a secondary engagement surface and a sear reset cam follower, and being moveable between a discharge position and a reset position; and a sear support including a sear support body having a sear engagement surface configured to engage the primary engagement surface of the sear body;

wherein a striker assembly located within a reciprocating slide assembly of a semiautomatic pistol comprises at least one sear reset cam surface defined therealong and configured to engage the sear reset cam follower of the sear upon a cycling movement of the reciprocating slide assembly after each discharge of the trigger mechanism.

5. A firearm, comprising:

a striker assembly;

a cocking piece moveable between a first position, second position and a third position so as to cock the striker assembly for discharging the firearm; and a trigger mechanism, comprising:

a sear having a sear body comprising a primary engagement surface, a secondary engagement surface, a sear support reset geometry including at least one reset cam defined along the sear body, and a sear reset cam follower geometry including at least one reset cam follower defined along the sear body, and the sear being moveable between a discharge position and a reset position; and a sear support including a sear support body having a sear engagement surface configured to engage primary engagement surface of the sear body and at least one cam follower arranged along the sear support body;

wherein the at least one reset cam of the sear cooperatively engages the at least one cam follower of the sear support as the sear is moved from its discharged position to its reset position so as to mechanically displace the sear support body toward a reset position of the sear support; and wherein the cocking piece is configured with at least one sear reset cam that cooperatively engages the reset cam follower of the sear, urging the sear to be displaced from its discharged position to its reset position whereby the primary engagement surface of the sear is placed into overlapping condition with the sear engagement surface of the sear support, as the cocking piece translates in a direction toward its first position.

6. The trigger mechanism of claim 1, wherein the sear support comprises a trigger, and a passive sear and trigger reset system including at least one compression spring configured to exert a selected sear reset force against the sear body and a trigger reset force against a trigger pull cam located between the trigger and the at least one compression spring and adapted to communicate the trigger reset force to the trigger via a mechanical advantage of the rigger pull cam contacting the trigger.

7. The trigger mechanism of claim 6, further comprising a trigger reset adjustment member located along the body of the trigger in a position to be engaged by the trigger pull cam; wherein the trigger reset adjustment member is moveable with respect to the trigger so as to adjust a position of contact between the trigger reset adjustment member and the trigger pull cam and selectively adjust the mechanical advantage to thereby adjust an amount of the trigger reset force applied against the trigger.

8. The trigger mechanism of claim 1, wherein the cocking piece is at least partially housed within a reciprocating slide assembly of a firearm; and wherein the slide assembly further comprises at least one sear reset cam surface defined along the reciprocating slide assembly, the at least one sear reset cam surface configured to engage the sear reset cam follower of the sear upon a cycling movement of the reciprocating slide assembly after discharge of the trigger mechanism.

9. The firearm of claim 1, wherein the trigger mechanism further comprises a housing and a safety arm pivotally attached to the housing; the safety arm having at least one cam surface configured to interact with a least one safety cam follower located along the body of the sear such that when the safety arm is placed in an On/Safe position, the sear is displaced to its reset position, causing the sear support to be displaced to its reset position.

10. The firearm of claim 5, wherein the sear support comprises a trigger body having a first portion defining a trigger bow, a second portion at which the at least one primary engagement surface is located; and a third portion having a passive trigger reset geometry that moves the trigger body to a reset position when engaged with sear support reset geometry of the sear body as the sear is moved from its discharged position to its reset position.

11. The firearm of claim 5, wherein the trigger mechanism further comprises a housing, and a safety arm pivotally coupled to the housing and including a cam surface configured to interact with at least one safety cam follower located along the body of the sear so as to place the sear in its reset position and cause the sear to urge the sear support to its reset position as the safety arm traverses a null position upon being moved from an Off/Fire position to an On/Safe position, so as to reset the sear support when the safety arm is in the null position.

12. The trigger mechanism of claim 5, wherein the trigger mechanism further comprises a trigger; and wherein the sear support comprises a connector located between the sear and the trigger, the connector having a first portion configured to be contacted by the trigger and rotate the connector when the trigger is pulled, and a second portion configured at which a primary engagement surface is located, and a third portion configured with a passive connector reset geometry that moves the sear support to its reset position when engaged with an active sear support reset geometry of the sear as the sear is moved from its discharged position to its reset position.

13. The trigger mechanism of claim 12, wherein the trigger comprises an engagement surface configured to cooperatively mate with a corresponding engagement surface of the connector so as to block the connector from rotating when the trigger has not been at least partially moved from an initial position and allowing the trigger to hold the corresponding engagement surface of the connector in an overlapping condition with the primary engagement surface of the sear body.

* * * * *